US009117440B2

(12) United States Patent
Mundt et al.

(10) Patent No.: US 9,117,440 B2
(45) Date of Patent: Aug. 25, 2015

(54) METHOD, APPARATUS, AND MEDIUM FOR DETECTING FREQUENCY EXTENSION CODING IN THE CODING HISTORY OF AN AUDIO SIGNAL

(75) Inventors: Harald H. Mundt, Fürth (DE); Arijit Biswas, Nuremberg (DE); Regunathan Radhakrishnan, Foster City, CA (US)

(73) Assignees: Dolby International AB, Amsterdam Zuidoost (NL); Dolby Laboratories Licensing Corporation, San Francisco, CA (US)

( * ) Notice: Subject to any disclaimer, the term of this patent is extended or adjusted under 35 U.S.C. 154(b) by 172 days.

(21) Appl. No.: 14/116,113

(22) PCT Filed: Apr. 30, 2012

(86) PCT No.: PCT/US2012/035785

§ 371 (c)(1),
(2), (4) Date: Nov. 6, 2013

(87) PCT Pub. No.: WO2012/158333

PCT Pub. Date: Nov. 22, 2012

(65) Prior Publication Data

US 2014/0088978 A1 Mar. 27, 2014

Related U.S. Application Data

(60) Provisional application No. 61/488,122, filed on May 19, 2011.

(51) Int. Cl.
*G10L 19/00* (2013.01)
*G10L 21/02* (2013.01)
(Continued)

(52) U.S. Cl.
CPC ..... *G10L 19/00* (2013.01); *G10L 19/008* (2013.01); *G10L 21/02* (2013.01); *G10L 21/038* (2013.01); *G10L 25/03* (2013.01)

(58) Field of Classification Search
None
See application file for complete search history.

(56) References Cited

U.S. PATENT DOCUMENTS 5,937,059 A 8/1999 Kim
7,003,451 B2 2/2006 Kjoerling
(Continued)

FOREIGN PATENT DOCUMENTS

CN 1765072 4/2006
CN 101140759 3/2008
(Continued)

OTHER PUBLICATIONS

Herre, J, et al "Analysis of Decompressed Audio—Inverse Decoder", 109th AES Convention, Sep. 2000.*
(Continued)

*Primary Examiner* — Pierre-Louis Desir
*Assistant Examiner* — Yi-Sheng Wang

(57) ABSTRACT

The present document relates to audio forensics, notably the blind detection of traces of parametric audio encoding/decoding. In particular, the present document relates to the detection of parametric frequency extension audio coding, such as spectral band replication (SBR) or spectral extension (SPX), from uncompressed waveforms such as PCM (pulse code modulation) encoded waveforms. A method for detecting frequency extension coding history in a time domain audio signal is described. The method may comprise transforming the time domain audio signal into a frequency domain, thereby generating a plurality of subband signals in a corresponding plurality of subbands comprising low and high frequency subbands; determining a degree of relationship between subband signals in the low frequency subbands and subband signals in the high frequency subbands; wherein the degree of relationship is determined based on the plurality of subband signals; and determining frequency extension coding history if the degree of relationship is greater than a relationship threshold.

17 Claims, 10 Drawing Sheets

(51) Int. Cl.

| | |
|---|---|
| ***G10L 25/03*** | (2013.01) |
| ***G10L 19/008*** | (2013.01) |
| ***G10L 21/038*** | (2013.01) |

(56) References Cited

U.S. PATENT DOCUMENTS

| | | | | |
|---|---|---|---|---|
| 7,260,520 | B2 | 8/2007 | Henn | |
| 7,328,161 | B2 | 2/2008 | Oh | |
| 7,451,091 | B2 | 11/2008 | Chong | |
| 7,469,206 | B2 | 12/2008 | Kjorling | |
| 7,548,864 | B2 | 6/2009 | Kjoerling | |
| 7,577,570 | B2 | 8/2009 | Kjoerling | |
| 7,660,991 | B2 | 2/2010 | Nakamura | |
| 7,668,722 | B2 | 2/2010 | Villemoes | |
| 7,756,715 | B2 * | 7/2010 | Kim et al. | 704/501 |
| 8,015,018 | B2 | 9/2011 | Seefeldt | |
| 8,532,983 | B2 * | 9/2013 | Gao | 704/201 |
| 2003/0107503 | A1 | 6/2003 | Herre | |
| 2003/0115041 | A1 * | 6/2003 | Chen et al. | 704/200.1 |
| 2004/0002856 | A1 * | 1/2004 | Bhaskar et al. | 704/219 |
| 2006/0235678 | A1 | 10/2006 | Kim | |
| 2007/0038439 | A1 | 2/2007 | Schuijers | |
| 2007/0129036 | A1 | 6/2007 | Arora | |
| 2008/0097764 | A1 | 4/2008 | Grill | |
| 2008/0126102 | A1 | 5/2008 | Shirakawa | |
| 2008/0140425 | A1 | 6/2008 | Shimada | |
| 2008/0243518 | A1 | 10/2008 | Oraevsky | |
| 2008/0260048 | A1 | 10/2008 | Oomen | |
| 2008/0263285 | A1 | 10/2008 | Sharma | |
| 2009/0041113 | A1 | 2/2009 | Oh | |
| 2009/0207775 | A1 | 8/2009 | Miyasaka | |
| 2009/0225868 | A1 | 9/2009 | Oh | |
| 2009/0228283 | A1 | 9/2009 | Toma | |
| 2010/0114583 | A1 | 5/2010 | Lee | |
| 2010/0211400 | A1 * | 8/2010 | Oh et al. | 704/500 |
| 2010/0286990 | A1 * | 11/2010 | Biswas et al. | 704/500 |

FOREIGN PATENT DOCUMENTS

| | | |
|---|---|---|
| EP | 1318611 | 6/2003 |
| EP | 1439524 | 7/2004 |
| JP | 2011-081033 | 4/2011 |
| WO | 2007/043811 | 4/2007 |
| WO | 2007/043840 | 4/2007 |
| WO | 2009/059631 | 5/2009 |
| WO | 2009/089728 | 7/2009 |
| WO | 2010/003539 | 1/2010 |
| WO | 2010/003543 | 1/2010 |
| WO | 2010/003546 | 1/2010 |
| WO | 2010/069885 | 6/2010 |

OTHER PUBLICATIONS

Herre, J. et al. "Analysis of Decompressed Audio—The Inverse Decoder", 109th AES Convention, Sep. 2000.

A.C. Den Brinker et al. "An Overview of the Coding Standard MPEG-4 Audio Amendments 1 and 2: HE-AAC, SSC and HE-AAC v2" EURASIP Journal on Audio, Speech, and Music Processing, vol. 2009.

Fielder, L.D. et al Introduction to Dolby Digital Plus, an Enhancement to the Dolby Digital Coding System. AES 117th Convention, San Francisco, CA, USA, Oct. 28-31, 2004.

3GPP TS 26.404: Enhanced aacPlus General Audio Codec; Encoder Specification SBR part.

Cooper, M et al. "Automatic Music Summarization via Similarity Analysis", in Proc. Third International Symposium on Musical Information Retrieval (ISMIR), pp. 81-85, Sep. 2002, Paris.

Otsu, N. "A Threshold Selection Method from Gray-Level Histograms", IEEE Transactions on Systems, Man, and Cybernetics, vol. 9, No. 1, 1979, pp. 62-66.

Herre J et al. "MPEG-4 High Efficiency AAC Coding (Standards in a Nutshell)" IEEE Signal Processing Magazine, IEEE Service Center, vol. 25, No. 3, May 1, 2008, pp. 137-142.

Lapierre, J et al. "On Improving Parametric Stereo Audio Coding", AES Convention 120, New York, USA, May 2006.

Moehrs, S. et al "Analysing Decompressed Audio with the "Inverse Decoder"—Towards an Operative Algorithm", AES, May 10, 2002, New York, USA.

* cited by examiner

METHOD, APPARATUS, AND MEDIUM FOR DETECTING FREQUENCY EXTENSION CODING IN THE CODING HISTORY OF AN AUDIO SIGNAL

CROSS-REFERENCE TO RELATED APPLICATIONS

This application claims priority to U.S. Patent Provisional Application No. 61/488,122, filed 19 May 2011, hereby incorporated by reference in its entirety.

TECHNICAL FIELD

The present document relates to audio forensics, notably the blind detection of traces of parametric audio encoding/decoding in audio signals. In particular, the present document relates to the detection of parametric frequency extension audio coding, such as spectral band replication (SBR) or spectral extension (SPX), and/or the detection of parametric stereo coding from uncompressed waveforms such as PCM (pulse code modulation) encoded waveforms.

BACKGROUND

HE-AAC (high efficiency-advanced audio coding) is an efficient music audio codec at low and moderate bitrates (e.g. 24-96 kb/s for stereo content). In HE-AAC, the audio signal is down-sampled by a factor of two and the resulting lowband signal is AAC waveform coded. The removed high frequencies are coded parametrically using SBR at low additional bitrate (typically at 3 kb/s per audio channel). As a result, the total bitrate can be reduced significantly compared to plain AAC waveform coding across the full spectral band of the audio signal.

The transmitted SBR parameters describe the way the higher frequency bands are generated from the AAC decoded low band output. This generation process of the high frequency bands comprises a copy-and-paste or copy-up process of patches from the lowband signal to the high frequency bands. In HE-AAC a patch describes a group of adjacent subbands that are copied-up to higher frequencies in order to recreate high frequency content that was not AAC coded. Typically 2-3 patches are applied dependent on the coding bitrate conditions. Usually the patch parameters do not change over time for one coding bitrate condition. However the MPEG standard allows changing the patch parameters over time. The spectral envelopes of the artificially generated higher frequency bands are modified based on envelope parameters which are transmitted within the encoded bitstream. As a result of the copy-up process and the envelope adjustment, the characteristics of the original audio signal may be perceptually maintained.

SBR coding may use other SBR parameters in order to further adjust the signal in the extended frequency range, i.e. to adjust the high-band signal, by noise and/or tone addition/removal.

The present document provides means to evaluate if a PCM audio signal has been coded (encoded and decoded) using parametric frequency extension audio coding such as MPEG SBR technology (e.g. using HE-AAC). In other words, the present document provides means for analyzing a given audio signal in the uncompressed domain and for determining if the given audio signal had been previously submitted to parametric frequency extension audio coding. In yet other words, given a (decoded) audio signal (e.g. in PCM format), it may be desirable to know whether or not the audio signal had previously been encoded using a certain encoding/decoding scheme. In particular, it may be desirable to know whether or not the high-frequency spectral components of the audio signal were generated by a spectral bandwidth replication process. In addition, it may be desirable to know if a stereo signal was created based on a transmitted mono signal or if certain time/frequency regions of a stereo signal originate from time/frequency data of the same mono signal.

It should be noted that even though the methods outlined in the present document are described in the context of audio coding, they are applicable to any form of audio processing that incorporates duplication of time/frequency data. In particular, the methods may be applied in the context of blind SBR which is a special case in audio coding where no SBR parameters are transmitted.

A possible use case may be the protection of SBR related intellectual property rights, e.g. the monitoring of unauthorized usage of MPEG SBR technology or any other new parametric frequency extension coding tool fundamentally based on SBR e.g., Enhanced SBR (eSBR) in MPEG-D Universal Speech and Audio Codec (USAC). Furthermore, transcoding and/or re-encoding may be improved when no more information other than the (decoded) PCM audio signal is available. By way of example, if it is known that the high-frequency spectral components of the decoded PCM audio signal have been generated by a bandwidth extension process, then this information could be used when re-encoding the audio signal. In particular, the parameters (e.g. the cross-over frequency and patch parameters) of the re-encoder could be set such that the high-frequency spectral components are SBR encoded, while the lowband signal is waveform encoded. This would result in bit-rate savings compared to plain waveform coding and higher quality bandwidth extension. Furthermore, knowledge regarding the encoding history of a (decoded) audio signal could be used for quality assurance of high bit-rate waveform encoded (e.g., AAC or Dolby Digital) content. This could be achieved by making sure that SBR coding or some other parametric coding scheme, which is not a transparent coding method, was not applied to the (decoded) audio signal in the past. In addition, the knowledge regarding the encoding history could be the basis for a sound quality assessment of the (decoded) audio signal, e.g. by taking into account the number and size of SBR patches detected within the (decoded) audio signal.

As such, the present document relates to the detection of parametric audio coding schemes in PCM encoded waveforms. The detection may be carried out by the analysis of repetitive patterns across frequency and/or audio channels. Identified parametric coding schemes may be MPEG Spectral Band Replication (SBR) in HE-AACv1 or v2, Parametric Stereo (PS) in HE-AAVv2, Spectral Extension (SPX) in Dolby Digital Plus and Coupling in Dolby Digital or Dolby Digital Plus. Since the analysis may be based on signal phase information, the proposed methods are robust against magnitude modifications as typically applied in parametric audio coding. In SBR coding schemes high frequency content is generated in the audio decoder by copying low frequency subbands into higher frequency regions and by adjusting the energy envelope in a perceptual sense. In parametric spatial audio coding schemes (e.g. PS, Coupling) data in multiple audio channels may be generated from transmitted data relating to only a single audio channel. The duplication of data may be tracked back robustly from PCM waveforms by analyzing phase information in frequency subbands.

SUMMARY

According to an aspect, a method for detecting frequency extension coding in the coding history of an audio signal, e.g.

a time domain audio signal, is described. In other words, the method described in the present document may be applied to a time domain audio signal (e.g. a pulse code modulated audio signal). The method may determine if the (time domain) audio signal had been submitted to a frequency extension encoding/decoding scheme in the past. Examples for such frequency extension coding/decoding schemes are enabled in HE-AAC and DD+ codecs.

The method may comprise transforming the time domain audio signal into a frequency domain, thereby generating a plurality of subband signals in a corresponding plurality of subbands. Alternatively, the plurality of subband signals may be provided, i.e. the method may obtain the plurality of subband signals without having to apply the transform. The plurality of subbands may comprise low and high frequency subbands. For this purpose, the method may apply a time domain to frequency domain transformation typically employed in a sound encoder, such as a quadrature mirror filter (QMF) bank, a modified discrete cosine transform, and/or a fast Fourier transform. As a result of such transformation, the plurality of subband signals may be obtained, wherein each subband signal may correspond to a different excerpt of the frequency spectrum of the audio signal, i.e. to a different subband. In particular, the subband signals may be attributed to low frequency subbands or alternatively high frequency subbands. Subband signals of the plurality of subband signals in a low frequency subband may comprise or may correspond to frequencies at or below a cross-over frequency, whereas subband signals of the plurality of subband signals in a high frequency subband may comprise or may correspond to frequencies above the cross-over frequency. In other words, the cross-over frequency may be a frequency defined within a frequency extension coder, whereas the frequency components of the audio signal above the cross-over frequency are generated from the frequency components of the audio signal at or below the cross-over frequency.

As such, the plurality of subband signals may be generated using a filter bank comprising a plurality of filters. For the correct identification of the patch parameters of the frequency extension scheme, the filter bank may have the same frequency characteristics (e.g. same number of channels, same center frequencies and bandwidths) as the filter bank used in the decoder of the frequency extension coder (e.g. 64 oddly stacked filters for HE-AAC and 256 oddly stacked filters for DD+). For enhanced robustness of the patch analysis it may be beneficial to minimize the leakage into adjacent bands by increasing the stop band attenuation. This can be accomplished e.g. with a higher filter order compared to the original filter bank (e.g. twice the filter order) used in the decoder. In other words, in order to ensure a high degree of frequency selectivity of the filter bank, each filter of the filter bank may have a roll-off which exceeds a predetermined roll-off threshold for frequencies lying within a stopband of the respective filter. By way of example, instead of using filters having a stop band attenuation of about 60 dB (as is the case for the filters used in HE-AAC), the stop band attenuation of the filters used for detecting audio extension coding may be increased to 70 or 80 dB, thereby increasing the detection performance. This means that the roll-off threshold may correspond to 70 or 80 dB attenuation. As such, it may be ensured that the filter bank is sufficiently selective in order to isolate different frequency components of the audio signal within different subband signals. A high degree of selectivity may be achieved by using filters which comprise a minimum number of filter coefficients. By way of example, the filters of the plurality of filters may comprise a number M of filter coefficients, wherein M may be greater than 640.

It should be noted that the audio signal may comprise a plurality of audio channels, e.g. the audio signal may be a stereo audio signal or a multi-channel audio signal such as a 5.1 or 7.1 audio signal. The method may be applied to one or more of the audio channels. Alternatively or in addition, the method may comprise the step of downmixing the plurality of audio channels to determine a downmixed time domain audio signal. As such, the method may be applied to the downmixed time domain audio signal. In particular, the plurality of subband signals may be generated from the downmixed time domain audio signal.

The method may comprise determining a maximum frequency of the audio signal. In other words, the method may comprise the step of determining the bandwidth of the time domain audio signal. The maximum frequency of the audio signal may be determined by analyzing a power spectrum of the audio signal in the frequency domain. The maximum frequency may be determined such that for all frequencies greater than the maximum frequency, the power spectrum is below a power threshold. As a consequence of the determination of the bandwidth of the audio signal, the method for detection coding history may be limited to the frequency spectrum of the audio signal up to the maximum frequency. As such, the plurality of subband signals may only comprise frequencies at or below the maximum frequency.

The method may comprise determining a degree of relationship between subband signals in the low frequency subbands and subband signals in the high frequency subbands. The degree of relationship may be determined based on the plurality of subband signals. By way of example, the degree of relationship may indicate a similarity between a group of subband signals in the low frequency subbands and a group of subband signals in the high frequency subbands. Such a degree of relationship may be determined through analysis of the audio signal and/or through use of a probabilistic model derived from a training set of audio signals with a frequency extension coding history.

It should be noted that the plurality of subband signals may be complex-valued, i.e. the plurality of subband signals may correspond to a plurality of complex subband signals. As such, the plurality of subband signals may comprise a corresponding plurality of phase signals and/or a corresponding plurality of magnitude signals, respectively. In such cases, the degree of relationship may be determined based on the plurality of phase signals. In addition, the degree of relationship may not be determined based on the plurality of magnitude signals. It has been found that for parametric coding schemes it is beneficial to analyze phase signals. Furthermore, complex waveform signals give useful information. In particular the information gained from complex and phase data may be used in combination to increase robustness of the detection scheme. This is notably the case where the parametric coding scheme involves a copy-up process of magnitude data along frequency (such as in a modulation spectrum codec).

Furthermore, the step of determining a degree of relationship may comprise determining a group of subband signals in the high frequency subbands which has been generated from a group of subband signals in the low frequency subbands. Such a group of subband signals may comprise subband signals from successive subbands, i.e. directly adjacent subbands.

The method may comprise determining frequency extension coding history if the degree of relationship is greater than a relationship threshold. The relationship threshold may be determined experimentally. In particular, the relationship threshold may be determined from a set of audio signals with a frequency extension coding history and/or a further set of audio signals with no frequency extension coding history.

The step of determining a degree of relationship may comprise determining a set of cross-correlation values between the pluralities of subband signals. A correlation value between a first and a second subband signal may be determined as an average over time of products of corresponding samples of the first and second subband signals at a pre-determined time lag. The pre-determined time lag may be zero. In other words, corresponding samples of the first and second subband signals at a given time instant (and at the pre-determined time lag) may be multiplied, thereby yielding a multiplication result at the given time instant. The multiplication results may be averaged over a certain time interval, thereby yielding an averaged multiplication result which may be used for determining a cross-correlation value.

It should be noted that in case of multi-channel signals (e.g. stereo or 5.1/7.1 signals), the multi-channel signal may be downmixed and the set of cross-correlation values may be determined on the downmixed audio signal. Alternatively, different sets of cross-correlation values may be determined for some or all channels of the multi-channel signal. The different sets of cross-correlation values may be averaged to determine an average set of cross-correlation values which may be used for the detection of copy-up patches. In particular, the plurality of subband signals may comprise K subband signals, K>0 (e.g. K>1, K smaller or equal to 64). The parameter K may be equal to the number of channels as used in the decoder of the frequency extension codec to generate the missing high frequency subbands. For the mere detection of spectral extension 64 bands may be sufficient (frequency patches are typically wider than the bandwidths in the 64 channels case). For correct patch identification of SPX in DD+ an increased number K of subbbands may be used (e.g. K=256). As such, the set of cross-correlation values may comprise (K−1)! cross-correlation values corresponding to all combinations of different subband signals from the plurality of subband signals. The step of determining frequency extension coding history in the audio signal may comprise determining that at least one maximum cross-correlation value from the set of cross-correlation values exceeds the relationship threshold.

It should be noted that the analysis methods outlined in the present document may be performed in a time dependent manner. As indicated above, frequency extension codecs typically use time-independent patch parameters. However, the frequency extension codecs may be configured to change patch parameters over time. This may be taken into account by analyzing windows of the audio signal. The windows of the audio signals may have a predetermined length (e.g. 10-20 seconds or shorter). In case of patch parameters which do not change over time, the robustness of the analysis methods described in the present document may be increased by averaging the set of cross-correlation values obtained for different windows of the audio signal. In order to decrease the complexity of the analysis methods, the different windows of the audio signal (i.e. different segments of the audio signal) may be averaged prior to determining the set of cross-correlation values based on the averaged windows of the audio signal.

The set of cross-correlation values may be arranged in a symmetrical KX K correlation matrix. The main diagonal of the correlation matrix may have arbitrary values, e.g. values corresponding to zero or value corresponding to auto-correlation values for the plurality of subband signals. The correlation matrix may be considered as an image from which particular structures or patterns may be determined. These patterns may provide an indication on the degree of relationship between the pluralities of subband signals. In view of the fact that the correlation matrix is symmetrical, only one "triangle" of the correlation matrix (either below or above the main diagonal) may need to be analyzed. As such, the method steps described in the present document may only be applied to one such "triangle" of the correlation matrix.

As indicated above, the correlation matrix may be considered as an image comprising patterns which indicate a relationship between low frequency subbands and high frequency subbands. The patterns to be detected may be diagonals of locally increased correlation parallel to the main diagonal of the correlation matrix. Line enhancement schemes may be applied to the correlation matrix (or a tilted version of the correlation matrix, wherein the correlation matrix may be tilted such that the diagonal structures turn into vertical or horizontal structures) in order to emphasize one or more such diagonals of local maximum cross-correlation values in the correlation matrix. An example line enhancement scheme may comprise convolving the correlation matrix with an enhancement matrix $$h = \frac{1}{6}\begin{bmatrix} 2 & -1 & -1 \\ -1 & 2 & -1 \\ -1 & -1 & 2 \end{bmatrix},$$

thereby yielding an enhanced correlation matrix. If line enhancement or any other pattern enhancement technique is applied, the step of determining frequency extension coding history may comprise determining that at least one maximum cross-correlation value from the enhanced correlation matrix, excluding the main diagonal, exceeds the relationship threshold. In other words, the determination of the degree of relationship may be based on the enhanced correlation matrix (and the enhanced set of cross-correlation values).

The method may be configured to determine particular parameters of the frequency extension coding scheme which had been applied to the time domain audio signal. Such parameters may e.g. be parameters relating to the subband copy-up process of the frequency extension coding scheme. In particular, it may be determined which subband signals in the low frequency subbands (the source subbands) had been copied up to subband signals in the high frequency subbands (the target subbands). This information may be referred to as patching information and it may be determined from diagonals of local maximum cross-correlation values within the correlation matrix.

As such, the method may comprise analyzing the correlation matrix to detect one or more diagonals of local maximum cross-correlation values. In order to detect such one or more diagonals, one or more of the following criteria may be applied: A diagonal of local maximum cross-correlation values may not lie on the main diagonal of the correlation matrix; and/or a diagonal of local maximum cross-correlation values may or should comprise more than one local maximum cross-correlation values, wherein each of the more than one local maximum cross-correlation values exceeds a minimum correlation threshold. The minimum correlation threshold is typically smaller than the relationship threshold.

A diagonal may be detected if the more than one local maximum cross-correlation values are arranged in a diagonal manner parallel to the main diagonal of the correlation matrix; and/or if for each of the more than one local maximum cross-correlation values in a given row of the correlation matrix, a cross-correlation value in the same row and a directly adjacent left side column is at or below the minimum correlation threshold and/or if a cross-correlation value in the same row and a directly adjacent right side column is at or below the minimum correlation threshold.

As outlined above, the analysis of the correlation matrix may be limited to only one "triangle" of the correlation matrix. It may occur that more than one diagonal of local maximum cross-correlation values are detected either above or below the main diagonal. This may be an indication that a plurality of copy-up patches had been applied within the frequency extension coding scheme. On the other hand, if more than two diagonals of local maximum cross-correlation values are detected, at least one of the more than two diagonals may indicate correlations between copy-up patches. Such diagonals do not indicate a copy-up patch and should be identified. Such inter-patch correlations may be employed to improve robustness of the detection scheme.

The correlation matrix may be arranged such that a row of the correlation matrix indicates a source subband and a column of the correlation matrix indicates a target subband. It should be noted that the arrangement with columns of the correlation matrix indicating the source subbands and rows of the correlation matrix indicating the target subbands is equally possible. In this case, the method may be applied by exchanging "rows" and "columns"

In order to isolate appropriate copy-up patches, the method may comprise detecting at least two redundant diagonals having local maximum cross-correlation values for the same source subband of the correlation matrix. The diagonal of the at least two redundant diagonals having the respective lowest target subbands may be identified as an authentic copy-up patch from a plurality of source subbands to a plurality of target subbands. The other diagonal(s) may indicate a correlation between different copy-up patches.

Having identified the copy-up diagonal(s), the pairs of source and target subbands of the diagonal indicate the low frequency subbands which have been copied up to high frequency subbands.

It may be observed that the edges of the copy-up diagonals (i.e. their start and/or end points) have a reduced maximum cross-correlation value with regards to the other correlation points of the diagonal. This may be due to the fact that the transform which was used to determine the plurality of subband signals has a different frequency resolution than the transform which was used within the frequency extension coding scheme applied to the time domain audio signal. As such, the detection of "weak" edges of the diagonal may indicate a mismatch of the filter bank characteristics (e.g. a mismatch of the number of subbands, a mismatch of the center frequencies, and/or a mismatch of the bandwidth of the subbands) and therefore may provide information on the type of frequency extension coding scheme which had been applied to the time domain audio signal.

In order to exploit the above mentioned observation, the method may comprise the step of detecting that local maximum cross-correlation values of a detected diagonal at a start and/or an end of the detected diagonal are below a blurring threshold. The blurring threshold is typically higher than the minimum correlation threshold. The method may proceed in comparing parameters of the transform step with parameters of transform steps used for a plurality of frequency extension coding schemes. In particular, the transformation orders (i.e. the number of subbands) may be compared. Based on the comparing step the frequency extension coding scheme, which has been applied to the audio signal, may be determined from the plurality of frequency extension coding schemes. By way of example, when using a filter bank with a high number of subbands (or channels) and if a patch border does not fall exactly on the grid of the filter bank used in HE-AAC, it can be concluded that the frequency extension coding scheme is not HE-AAC.

The correlation matrix may be analyzed, in order to detect a particular decoding mode applied by the frequency extension coding scheme. This applies e.g. to HE-AAC which allows for low power (LP) or High Quality (HQ) decoding. For this purpose, various correlation thresholds may be defined. In particular, it may be determined that the maximum cross-correlation value from the set of cross-correlation values is either below or above a decoding mode threshold, thereby detecting a decoding mode of a frequency extension coding scheme applied to the audio signal. The decoding mode threshold may be greater than the minimum correlation threshold. Furthermore, the decoding mode threshold may be greater than the relationship threshold. In the case of LP or HQ decoding, LP decoding may be detected if the maximum cross-correlation value is below the decoding mode threshold (but above the relationship threshold). HQ decoding may be detected if the maximum cross-correlation value is above the decoding mode threshold.

As indicated above, the degree of relationship between subband signals in low frequency subbands and subband signals in high frequency subbands may involve the usage of a probabilistic model. As such, the method may comprise the step of providing a probabilistic model determined from a set of training vectors derived from training audio signals with a frequency extension coding history. The probabilistic model may describe a probabilistic relationship between vectors in a vector space spanned by the plurality of high frequency subbands and the low frequency subbands. Assuming that the plurality of subbands comprises K subbands, the vector space may have a dimension of K. Alternatively or in addition, the probabilistic model may describe a probabilistic relationship between vectors in a vector space spanned by the plurality of subbands and the low frequency subbands. Assuming that the plurality of subbands comprises K subbands of which $K_l$ are low frequency subbands, the vector space may have a dimension of $K+K_l$. In the following the latter probabilistic model is described in further detail. However, the method is equally applicable for the first probabilistic model.

The probabilistic model may be a Gaussian Mixture Model. In particular, the probabilistic model may comprise a plurality of mixture components, each mixture component having a mean vector $\mu$ in the vector space and a covariance matrix C in the vector space. The mean vector $\mu_i$ of an $i^{th}$ mixture component may represent a centroid of a cluster in the vector space; and the covariance matrix $C_i$ of the $i^{th}$ mixture component may represent a correlation between the different dimensions in the vector space. The mean vectors $\mu_i$ and the covariance matrices $C_i$, i.e. the parameters of the probabilistic model, may be determined using a set of training vectors in the vector space, wherein the training vectors may be determined from a set of training audio signals with a frequency extension coding history.

The method may comprise the step of providing an estimate of the plurality of subband signals given the subband signals in the low frequency subband. The estimate may be determined based on the probabilistic model. In particular, the estimate may be determined based on the mean vectors $\mu_i$ and the covariance matrices $C_i$ of the probabilistic model.

Even more particularly, the estimate may be determined as $$F(x) = E[y \mid x] = \sum_{i=1}^{Q} h_i(x)[\mu_i^y + C_i^{yx} C_i^{xx-1}(x - \mu_i^x)],$$

with E[y|x] being the estimate of the plurality of subband signals y given the subband signals x in the low frequency subbands, with $h_i(x)$ indicating a relevance of the $i^{th}$ mixture component of the Gaussian Mixture Model given the subband signals x, with $\mu_i^y$ being a component of the mean vector $\mu_i$ corresponding to the subspace of the plurality of subbands, with $\mu_i^x$ being a component of the mean vector $\mu_i$ corresponding to the subspace of the low frequency subbands, with Q being the number of components of the Gaussian Mixture Model, and with $C_i^{yx}$ and $C_i^{xx}$ being sub-matrices from the covariance matrix $C_i$.

The relevance indicator $h_i(x)$ may be determined as the probability that subband signals x in the low frequency subbands fall within the $i^{th}$ mixture component of the Gaussian Mixture Model, i.e. as $$h_i(x) = \frac{\dfrac{\alpha_i}{(2\pi)^{n/2}|C_i^{xx}|^{1/2}} \exp\left[-\frac{1}{2}(x - \mu_i^x)^T C_i^{xx-1}(x - \mu_i^x)\right]}{\displaystyle\sum_{j=1}^{Q} \frac{\alpha_j}{(2\pi)^{n/2}|C_j^{xx}|^{1/2}} \exp\left[-\frac{1}{2}(x - \mu_j^x)^T C_j^{xx-1}(x - \mu_j^x)\right]},$$

$$\text{with } \sum_{i=1}^{Q} \alpha_i = 1, \alpha_i \geq 0.$$

Having provided an estimate, a degree of relationship may be determined based on an estimation error derived from the estimate of the plurality of subband signals and the plurality of subband signals. The estimation error may be a mean square error.

The audio signal may be a multi-channel signal, e.g. comprising a first and a second channel. The first and second channels may be left and right channels, respectively. In this case, it may be desirable to determine particular parametric encoding schemes applied on the multi-channel signals, such as MPEG parametric stereo encoding or coupling as used by DD(+) (or MPEG intensity stereo). This information may be detected from the plurality of subband signals of the first and second channels. In order to determine the plurality of subband signals of the first and second channels, the method may comprise transforming the first and the second channels into the frequency domain, thereby generating a plurality of first subband signals and a plurality of second subband signal. The first and second subband signals may be complex-valued and may comprise first and second phase signals, respectively. Consequently, a plurality of phase difference subband signals may be determined as the difference of corresponding first and second subband signals.

The method may proceed in determining a plurality of phase difference values, wherein each phase difference value may be determined as an average over time of samples of the corresponding phase difference subband signal. Parametric stereo encoding in the coding history of the audio signal may be determined by detecting a periodic structure within the plurality of phase difference values. In particular, the periodic structure may comprise an oscillation of phase difference values of adjacent subbands between positive and negative phase difference values, wherein a magnitude of the oscillating phase difference values exceeds an oscillation threshold.

In order to detect coupling of the first and second channel or coupling between multiple channels in the case of general multi-channel signals, the method may comprise the step of determining, for each phase difference subband signal, a fraction of samples having a phase difference smaller than a phase difference threshold. Coupling of the first and second channel in the coding history of the audio signal may be determined when detecting that the fraction exceeds a fraction threshold, in particular for subband signals in the high frequency subbands.

According to another aspect, a method for detecting the use of a parametric audio coding tool (e.g. parametric stereo coding or coupling) in the coding history of an audio signal is described. The audio signal may be a multi-channel signal comprising a first and a second channel, e.g. comprising a left and a right channel. The method may comprise the step of providing a plurality of first subband signals and a plurality of second subband signals. The plurality of first subband signals may correspond to a time/frequency domain representation of the first channel of the multi-channel signal. The plurality of second subband signals may correspond to a time/frequency domain representation of the second channel of the multi-channel signal. As such, the plurality of first and second subband signals may have been generated using a time domain to frequency domain transform (e.g. a QMF). The plurality of first and second subband signals may be complex-valued and may comprise a plurality of first and second phase signals, respectively.

The method may comprise the step of determining a plurality of phase difference subband signals as the difference of corresponding first and second phase signals from the plurality of first and second phase signals. The use of a parametric audio coding tool in the coding history of the audio signal may be detected from the plurality of phase difference subband signals.

In particular, the method may comprise the step of determining a plurality of phase difference values, wherein each phase difference value may be determined as an average over time of samples of the corresponding phase difference subband signal. Parametric stereo encoding in the coding history of the audio signal may be detected by detecting a periodic structure within the plurality of phase difference values.

Alternatively or in addition, the method may comprise the step of determining, for each phase difference subband signal, a fraction of samples having a phase difference smaller than a phase difference threshold. A coupling of the first and second channel in the coding history of the audio signal may be detected by detecting that the fraction exceeds a fraction threshold for subband signals at frequencies above a cross-over frequency (also referred to as the coupling start frequency in the context of coupling), e.g. for the subband signals in the high frequency subbands.

According to a further aspect, a software program is described, which is adapted for execution on a processor and for performing the method steps outlined in the present document when carried out on a computing device.

According to another aspect, a storage medium is described, which comprises a software program adapted for execution on a processor and for performing the method steps outlined in the present document when carried out on a computing device.

According to another aspect, a computer program product is described which comprises executable instructions for performing the method outlined in the present document when executed on a computer.

It should be noted that the methods and systems including its preferred embodiments as outlined in the present document may be used stand-alone or in combination with the other methods and systems disclosed in this document. Furthermore, all aspects of the methods and systems outlined in the present document may be arbitrarily combined. In particular, the features of the claims may be combined with one another in an arbitrary manner.

BRIEF DESCRIPTION OF THE FIGURES

The invention is explained below in an exemplary manner with reference to the accompanying drawings, wherein.

DETAILED DESCRIPTION

Figure 1A:
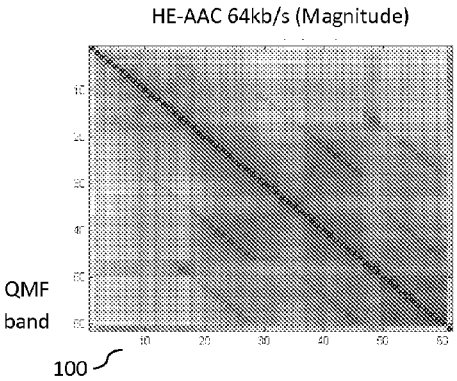
FIGS. 1*a*-1*f* illustrates an example correlation based analysis using magnitude, complex and/or phase data.

As has been outlined above, in MPEG SBR encoding an audio signal is waveform encoded at a reduced sample-rate and bandwidth. The missing higher frequencies are reconstructed in the decoder by copying low frequency parts to high frequency parts using transmitted side information. The transmitted side information (e.g. spectral envelope parameters, noise parameters, tone addition/removal parameters) is applied to the patches from the lowband signal, wherein the patches have been copied-up or transposed to higher frequencies. As a result of this copy-up process, there should be correlations between certain spectral portions of the lowband signal and copied-up spectral portions of the highband signal. These correlations could be the basis for detecting spectral band replication based encoding within a decoded audio signal.

The correlation between spectral portions of the lowband signal and spectral portions of the highband signal may have been reduced or removed by the application of the side information, i.e. the SBR parameters, onto the copied-up patches. However, it has been observed that the application of SBR parameters onto the copied-up patches does not significantly affect the phase characteristics of the copied-up patches (i.e. the phases of the complex valued subband coefficients). In other words, the phase characteristics of copied-up low frequency bands are largely preserved in the higher frequency bands. The extent of preservation typically depends on the bitrate of the encoded signal and on the characteristics of the encoded audio signal. As such, the correlation of phase data in the spectral portions of the (decoded) audio signal can be used to trace back the frequency patching operations performed in the context of SBR encoding.

In the following, several correlation based analysis methods of PCM waveforms are described. These methods may be used to detect remnants of audio coding employing parametric frequency extension tools such as SBR in MPEG HE-AAC or SPX in Dolby Digital Plus (DD+). In addition, particular parameters, specifically the patching information of the frequency extension process may be extracted. This information may be useful for an efficient re-encoding. Moreover additional measures are described that indicate the presence of MPEG Parametric Stereo (PS) as used in HE-AACv2 and the presence of Coupling as used in DD(+).

It should be noted that the basic principle of bandwidth extension as used in DD+ is similar to MPEG SBR. Consequently, the analysis techniques outlined in this document in the context of MPEG SBR encoded audio signals are equally applicable to audio signals which had previously been DD+ encoded. This means that even though the analysis methods are outlined in the context of HE-AAC, the methods are also applicable to other bandwidth extension based encoders such as DD+.

The audio signal analysis methods should be able to operate for the various operation modes of the audio encoders/decoders. Furthermore, the analysis methods should be able to distinguish between these different operation modes. By way of example, HE-AAC codecs make use of two different HE-AAC decoding modes: High Quality (HQ) and Low Power (LP) decoding. In the LP mode, the decoder complexity is reduced by using a real valued critically sampled filter bank compared to a complex oversampled filter bank used in the HQ mode. Usually small inaudible aliasing products may be present in audio signals which have been decoded using the LP mode. These aliasing products may affect the audio quality and it is therefore desirable to detect the decoding mode which has been used to decode the analyzed PCM audio signal. In a similar manner, different decoding modes or complexity modes should also be identified in other frequency extension codecs such as USAC based on SBR.

For HE-AACv2, which applies PS (parametric stereo), the decoder typically uses the HQ mode. PS enables an improved audio quality at low bitrates such as 20-32 kb/s, however, it cannot usually compete with the stereo quality of HE-AACv1 at higher bitrates such as 64 kb/s. HE-AACv1 is most efficient at bitrates between 32 and 96 kb/s, however, it is not transparent for higher bitrates. In other words, PS (HE-AACv2) at 64 kb/s typically provides a worse audio quality than HE-AACv1 at 64 kb/s. On the other hand, PS at 32 kb/s will usually be only slightly worse than HE-AACv1 at 64 kb/s but much better than HE-AACv1 at 32 kb/s. Therefore knowledge about the actual coding conditions may be a useful indicator to provide a rough audio quality assessment of the (decoded) audio signal.

Coupling as used e.g. in Dolby Digital (DD) and DD+ makes use of the hearing phase insensitivity at high frequencies. Conceptually, coupling is related to the MPEG Intensity Stereo (IS) tool, where only a single audio channel (or the coefficients related to the scale factor band of only one audio channel) is transmitted in the bitstream along with inter channel level difference parameters. Due to time/frequency sharing of these parameters, the bitrate of the encoded bitstream can be reduced significantly especially for multi-channel audio. As such, the frequency bins of the reconstructed audio channels are correlated for shared side level information, and this information could be used in order to detect an audio codec making use of coupling.

In a first approach, the (decoded) audio signal, e.g. the PCM waveform signal, may be transformed into the time/frequency domain using an analysis filter bank. In an embodiment, the analysis filter bank is the same analysis filter bank as used in an HE-AAC encoder. By way of example, a 64 band complex valued filter bank (which is oversampled by a factor of two) may be used to transform the audio signal into the time/frequency domain. In case of a multi-channel audio signal, the plurality of channels may be downmixed prior to the filter bank analysis, in order to yield a downmixed audio signal. As such, the filter bank analysis (e.g. using a QMF filter bank) may be performed on the downmixed audio signal. Alternatively, the filter bank analysis may be performed on some or all of the plurality of channels.

As a result of the filter bank analysis, a plurality of complex subband signals is obtained for the plurality of filter bank subbands. This plurality of complex subband signals may be the basis for the analysis of the audio signal. In particular, the phase angles of the plurality of complex subband signals or the plurality of complex QMF bins may be determined.

Furthermore, the bandwidth of the audio signal may be determined from the plurality of complex subband signals using power spectrum analysis. By way of example, the average energy within each subband may be determined. Subsequently, the cutoff subband may be determined as the subband for which all subbands at higher frequencies have an average energy below a pre-determined energy threshold value. This will provide a measure of the bandwidth of the audio signal. Furthermore, the analysis of the correlation between the subbands of the audio signal may be limited to subbands having frequencies with the cutoff subband or below (as will be described below).

In addition, the cross-correlation at zero lag between all QMF bands over the analysis time range may be determined, thereby providing a self-similarity matrix. In other words, the cross-correlation (at a time lag of zero) between all pairs of subband signals may be determined. This results in a symmetrical self-similarity matrix, e.g. in a 64×64 matrix in case of 64 QMF bands. This self-similarity matrix may be used to detect repeating structures in the frequency-domain. In particular, a maximum correlation value (or a plurality of maximum correlation values) within the self-similarity matrix may be used to detect spectral band replication within the audio signal. For the determination of the one or more maximum correlation values, auto-correlation values within the main diagonal should be excluded (as the auto-correlation values do not provide an indication of the correlation between different subbands). Furthermore, the determination of the maximum value could be limited to the limits of the previously determined audio bandwidth, i.e. the determination of the self-similarity matrix may be limited to the cutoff subband and the subbands at lower frequencies.

It should be noted that in case of multi-channel audio signals, the above procedure can be applied to all channels of the multi-channel audio signal independently. In this case, a self-similarity matrix could be determined for each channel of the multi-channel signal. The maximum correlation value across all audio channels could be taken as an indicator for the presence of SBR based encoding within the multi-channel audio signal. In particular, if the maximum cross-correlation value exceeds a pre-determined correlation threshold, the waveform signal may be classified as coded by a frequency extension tool.

It should be noted that the above procedure may also be based on the complex or the magnitude QMF data (as opposed to the phase angle QMF data). However, since in frequency extension coding, the magnitude envelopes of the patched lowband signals are modified in accordance to the original high frequency data, a reduced correlation may be expected when basing the analysis on magnitude data.

In FIGS. 1*a*-1*f*, self-similarity matrices are examined for an audio signal which had been submitted to HE-AAC (left column) and plain AAC (right column) codecs. All images are scaled between 0 and 1, where 1 corresponds to black and 0 to white. The x and y axis of the matrices in FIG. 1 correspond to the subband indices. The main diagonals in these images correspond to the auto-correlation of the particular QMF band. The maximum analyzed QMF band corresponds to the estimated audio bandwidth which is typically higher for the HE-AAC condition than for the plain AAC condition. In other words, the bandwidth or cut-off frequency of the (decoded) audio signal may be estimated, e.g. based on power spectral analysis. Spectral bands of the audio signal which are above the cut-off frequency will typically comprise a large amount of noise, so that cross-correlation coefficients for spectral bands which are above the cut-off frequency will typically not yield sensible results. In the illustrated examples, 62 out of 64 QMF bands are analyzed for the HE-AAC encoded signal, wherein 50 out of 64 QMF bands are analyzed for the AAC encoded signal.

Lines of high correlation which run parallel to the main diagonal indicate a high degree of correlation or similarity between QMF bands and therefore potentially indicate frequency patches. The presence of these lines implies that a frequency extension tool has been applied to the (decoded) audio signal.

Figure 1B:
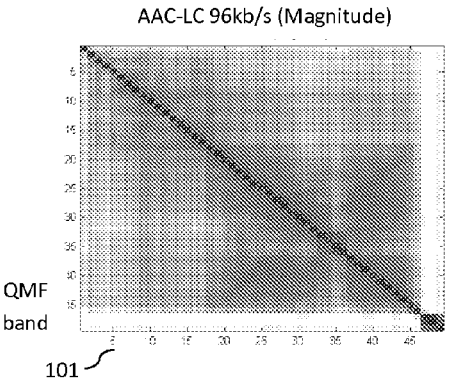
Figure 1C:
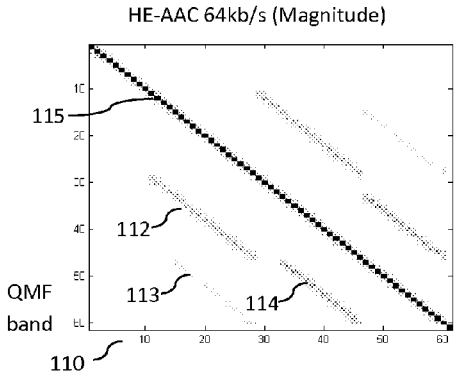

In FIGS. 1*a*-1*b*, self-similarity matrices 100, 101 are illustrated which have been determined based on magnitude information of the complex QMF subband signals. It can be seen that an analysis which is only based on the magnitude of the QMF subbands results in correlation coefficients having a relatively small dynamic range (in other words, images with low contrast). Consequently, a magnitude-only analysis may not be well suited for a robust frequency extension analysis. Nevertheless, the HE-AAC patch information (illustrated by diagonals along the sides of the center diagonal) is visible when determining the self-similarity matrix using only the magnitude of the QMF subbands.

It can be seen that the dynamic range for a phase based analysis (middle row of FIGS. 1*c*-1*d*) is higher and thus better suited for the analysis of frequency extension. In particular, the phase-only based self-similarity matrices 110 and 111 are shown for HE-AAC and AAC encoded audio signals, respectively. The main diagonal 115 indicates the auto-correlation coefficients of the phase values of the QMF subbands. Furthermore, diagonals 112 and 113 indicate an increased correlation between lowbands with subband indices in the range of 11 to 28 and highbands with indices in the range of 29 to 46 and 47 to 60, respectively. The diagonals 112 and 113 indicates a copy-up patch from the lowbands with indices of approx. 11 to 28 to the highbands with indices of approx. 29 to 46 (reference numeral 112), as well as a copy-up patch from the lowbands with indices of approx. 15 to 28 to the highbands with indices of approx. 47 to 60 (reference numeral 113). It should be noted, however, that the correlation values of the second HE-AAC patch 113 are relatively weak. Furthermore, it should be noted that the diagonal 114 does not identify a copy-up patch within the audio signal. The diagonal 114 rather illustrates the similarity or correlation between the two copy-up patches 112 and 113.

Figure 1D:
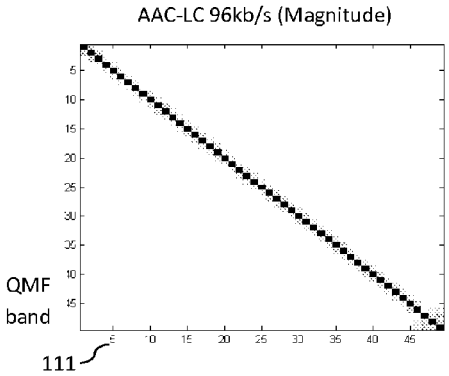
Figure 1E:
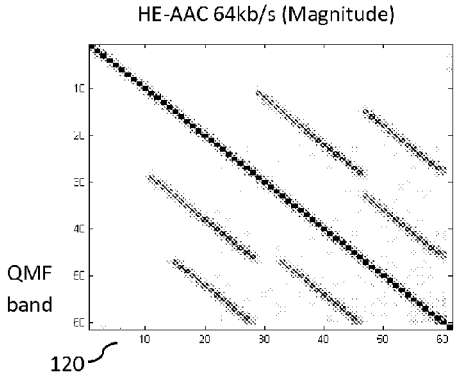
Figure 1F:
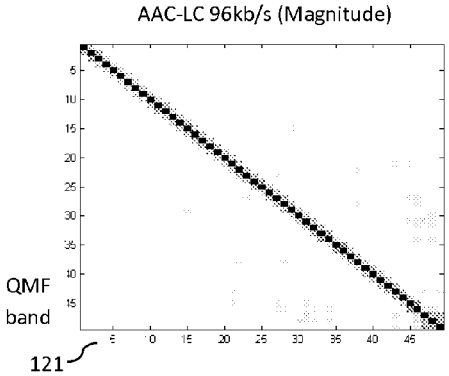

The self-similarity matrices 120, 121 in FIGS. 1*d*-1*e* have been determined using the complex QMF subband data (i.e. magnitude and phase information). It can be observed that all HE-AAC patches are clearly visible, however, the lines indicating high correlation are slightly less sharp and the overall dynamic range smaller than in the phase-only based analysis shown in matrices 110, 111.

For further evaluation of the above described analysis method, the maximum cross-correlation value derived from the self-similarity matrices 110, 111, 120, 121 has been plotted for 160 music files and 13 different coding conditions. The 13 different coding conditions comprise coders with and without parametric frequency extension (SBR/SPX) tools as listed in Table 1.

TABLE 1

| | Bitrate | Codec(s) |
|---|---|---|
| | 64 kb/s | HE-AACv1 (HQ) |
| | 64 kb/s | HE-AACv1 (LP) |
| | 48 kb/s | HE-AACv1 (HQ) |
| | 48 kb/s | HE-AACv1 (LP) |
| | 32 kb/s | HE-AACv2 |
| | 64 kb/s + 192 kb/s | HE-AACv1 (HQ) + AAC-LC |
| | 48 kb/s + 192 kb/s | HE-AACv1 (HQ) + AAC-LC |
| | 32 kb/s + 192 kb/s | HE-AACv2 + AAC-LC |
| | 192 kb/s | AAC-LC |
| 0 | 96 kb/s | AAC-LC |
| 1 | 128 kb/s | DD+ (no SPX, no Coupling) |
| 2 | 128 kb/s | DD+ (with SPX) |
| 3 | 128 kb/s | DD+ (with Coupling) |

Table 1 shows the different coding conditions which have been analyzed. It has been observed that copy-up patches and thus frequency extension based coding can be detected with a reasonable degree of certainty. This can also be seen in FIGS. 2*a* and 2*d*, where the maximum correlation values 200, 220 and probability density functions 210, 230 are illustrated for the audio conditions 1 to 13 listed in Table 1. The overall detection reliability of the use of parametric frequency extension coding is close to 100% when appropriately choosing a detection threshold as shown in the context of FIGS. 5*b* and 6*b*.

Figure 2A:
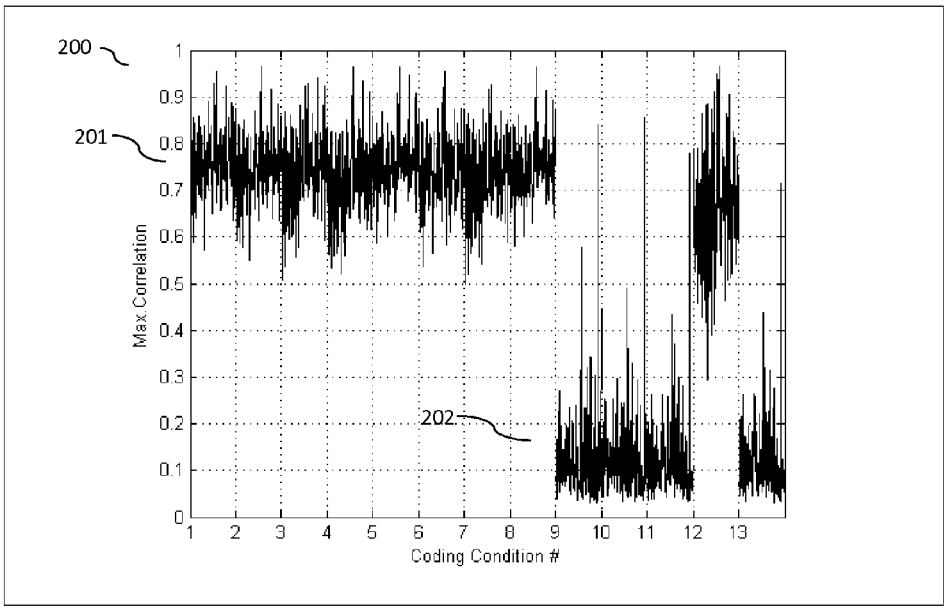
FIGS. 2*a*, 2*b*, 2*c* and 2*d* show example maximum cross-correlation values and probability density functions based on complex and phase-only data.
Figure 2B:
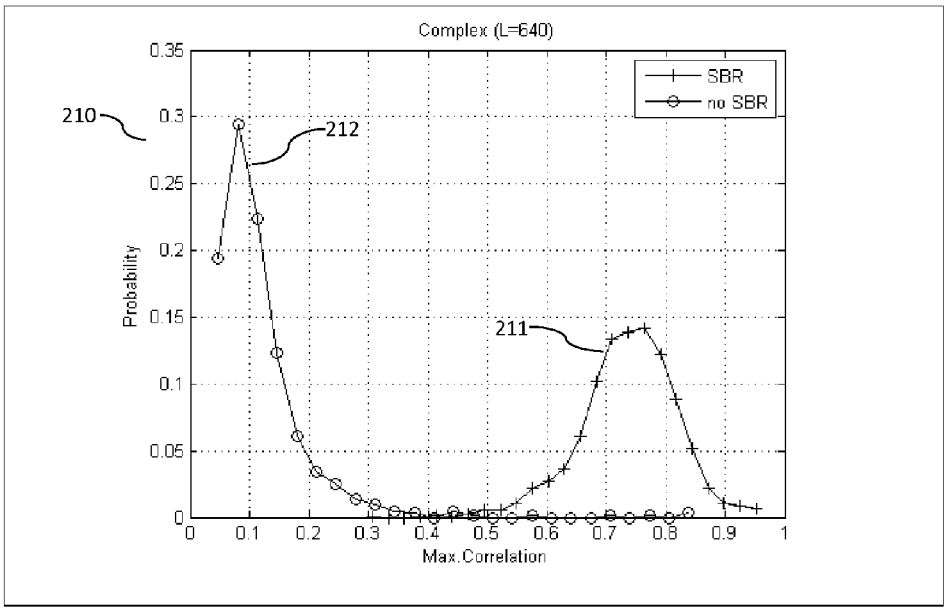
Figure 2C:
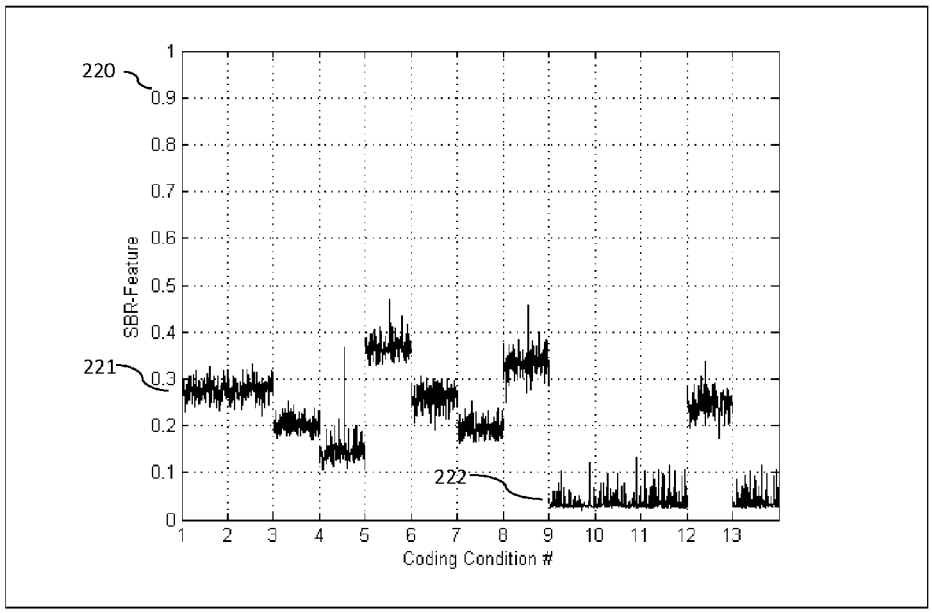
Figure 2D:
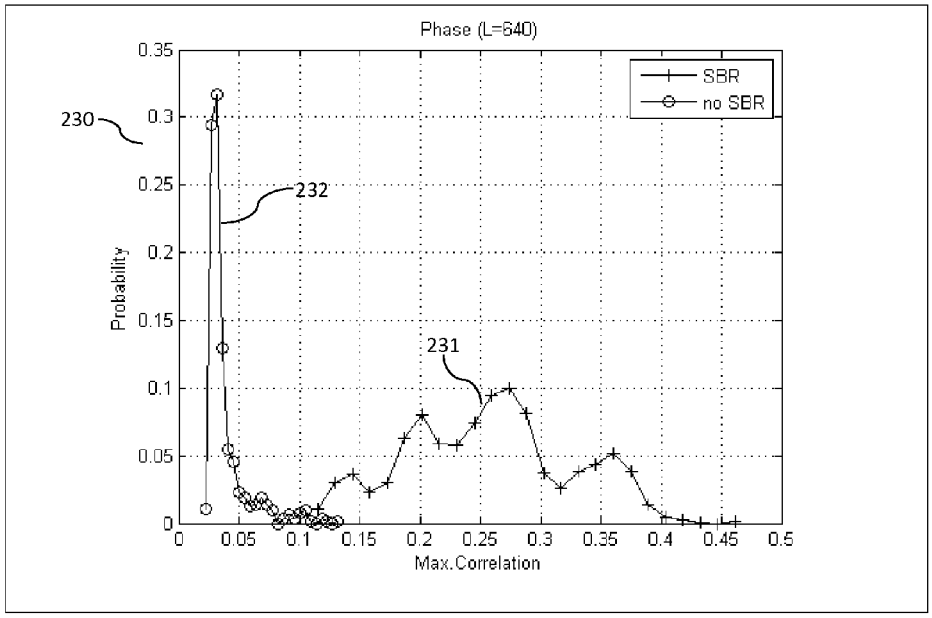

The analysis results shown in FIGS. 2*a*-2*b* are based on the complex subband data (i.e. phase and magnitude), whereas the analysis results shown in FIG. 2*c*-2*d* are based on only on the phase of the QMF subbands. It can be seen from the diagram 200 that audio signals which had been submitted to an parametric frequency extension based encoding (SBR or SPX) scheme (codecs Nr. 1 to 8, and Nr. 12) have higher maximum correlation values 201 than audio signals which had been submitted to encoding schemes that do not involve any parametric frequency extension encoding (codecs Nr. 9 to 11 and Nr. 13) (see reference numeral 202). This is also shown in the probability density functions 211 (for SBR/SPX based codecs Nr. 1 to 8, and Nr. 12) and 212 (for non SBR/SPX based codecs Nr. 9 to 11 and Nr. 13) in diagram 210. Similar results are obtained for the phase-only analysis illustrated in FIG. 2*c*-2*d* (diagram 220 illustrates the maximum correlation values 221 and 222; diagram 230 illustrates the probability density functions 231, 232 for SBR/SPX and non SBR based codecs).

Figure 3:
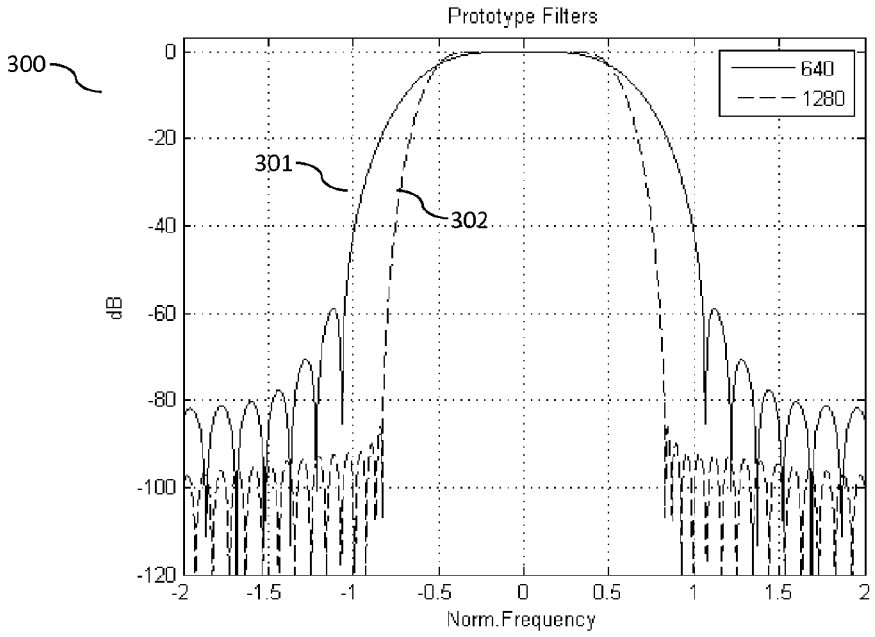
FIG. 3 illustrates example frequency responses of prototype filters which may be used for the correlation based analysis.

The robustness of the correlation based analysis method may be improved by various measures, such as the selection of an appropriate analysis filter bank. Leakage from (modified) adjacent QMF bands may change the original low frequency band phase characteristics. This may have an impact on the degree of correlation which may be determined between the phases of different QMF bands. As such, it may be beneficial to select an analysis filter bank which provides for a sharp frequency separation. The frequency separation of the analysis filter bank may be sharpened by designing the modulated analysis filter banks using prototype filters with an increased length. In an example, a prototype filter with 1280 samples length (compared to 640 samples length of the filter used for the results of FIGS. 2*a*-2*d*) has been designed and implemented. The frequency response of the longer prototype filter 302 and the frequency response of the original prototype filter 301 are shown in FIG. 3. The increased stop band attenuation of the new filter 302 is clearly visible.

Figure 4A:
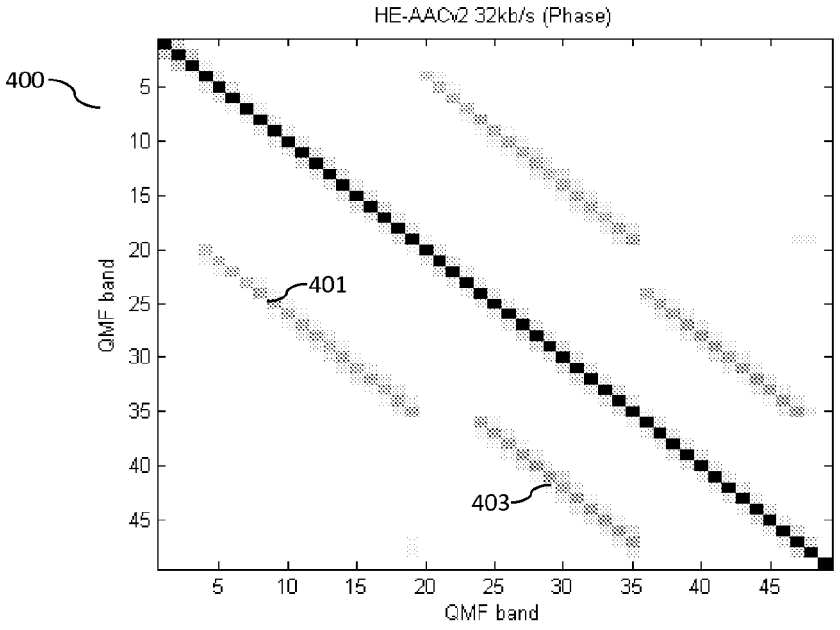
FIGS. 4*a* and 4*b* illustrate a comparison between example similarity matrices determined using different analysis filter banks.
Figure 4B:
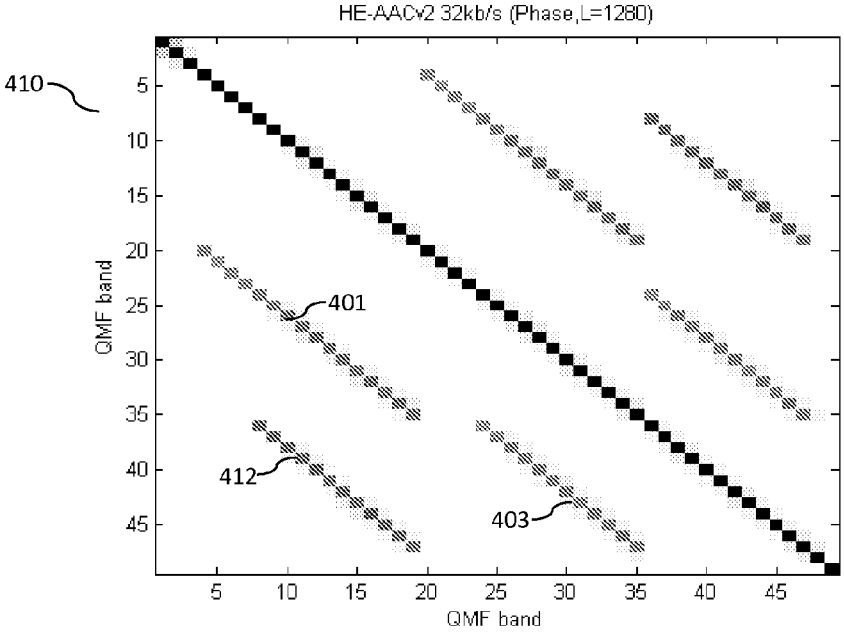

FIGS. 4*a* and 4*b* illustrate the self-similarity matrices 400 and 410 which have been determined based on phase-only data of the QMF subbands. For the matrix 400 the shorter filter 301 has been used, whereas for the matrix 410 the longer filter 302 has been used. A first frequency patch 401 is indicated by the diagonal line starting at QMF band 3 (x-axis) and covers target QMF bands from band index 20 to 35 (y-axis). For the higher selective filter used for matrix 410, a second frequency patch 412 becomes visible starting at QMF band Nr. 8. This second frequency patch 412 is not identified in matrix 400 derived using the original filter 301.

It should be noted that the presence of the second patch 412 can be deduced from the diagonal line 403 starting at QMF band 25 on the x-axis. However, since the band 25 is a target QMF band of the first patch, the diagonal line 403 indicates the inter-patch similarity for QMF source bands that are employed in both patches. It should be further noted that QMF source band regions may overlap, but target QMF band regions may not. This means that QMF source bands may be patched to a plurality of target QMF bands, however, typically every target QMF band has a unique conesponding QMF source band. It can also be observed that by using highly separating analysis filter banks 302, the similarity indicating lines 401, 412 of FIG. 4*b* have an increased contrast and an increased sharpness compared to the similarity indicating line 401 in FIG. 4*a* (which has been determined using a less selective analysis filter bank 301).

Figure 5A:
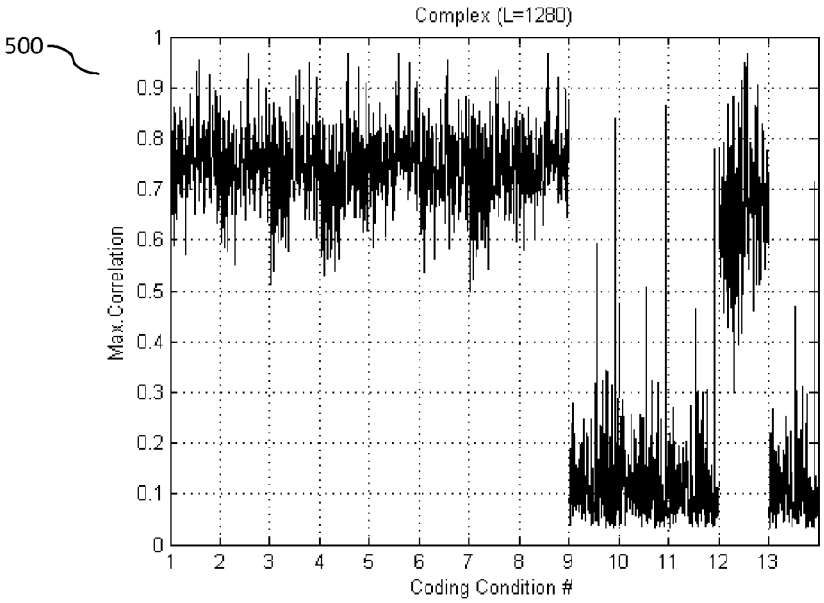
FIG. 5 shows example maximum cross-correlation values determined using different analysis filter banks.
Figure 5B:
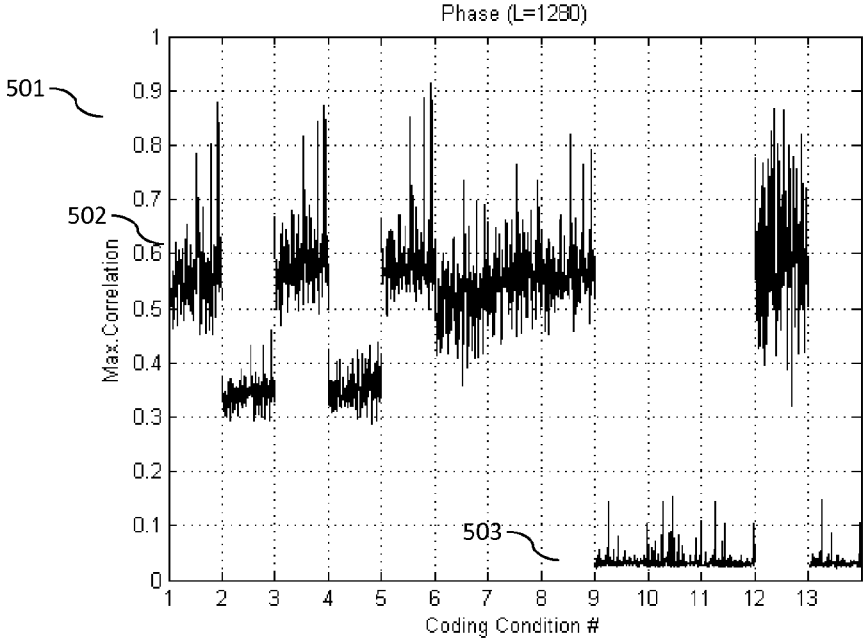

The highly selective prototype filter 302 has been evaluated for phase-only data and complex data based analysis as shown in FIGS. 5*a* and 5*b*. The complex data based maximum correlation values 500 are similar to the correlation values 200 determined using the less selective original filter 301 (see FIG. 2*a*). However, the phase-only based maximum correlation values 501 are clearly separated into two clusters 502 and 503, cluster 502 indicating audio signals which have been encoded with frequency extension and cluster 503 indicating audio signals which have been encoded without frequency extension. In addition, the use of Low Power SBR decoding (coding conditions 2, 4) can be distinguished from the use of High Quality SBR decoding (coding conditions 1, 3, 5). This is at least the case when no subsequent re-encoding is performed (as in coding conditions 6, 7, 8).

Figure 6A:
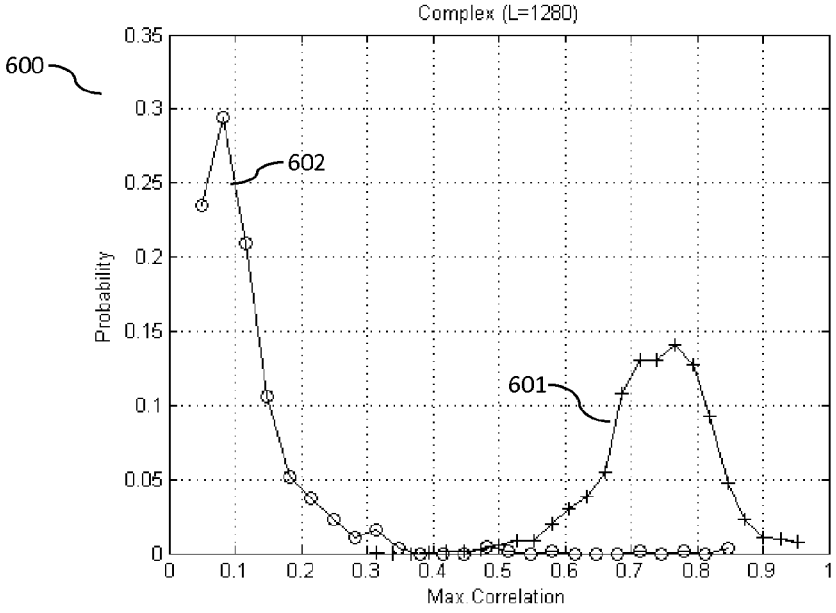
FIGS. 6*a*, 6*b* and 6*c* show example probability density functions determined using different analysis filter banks.
Figure 6B:
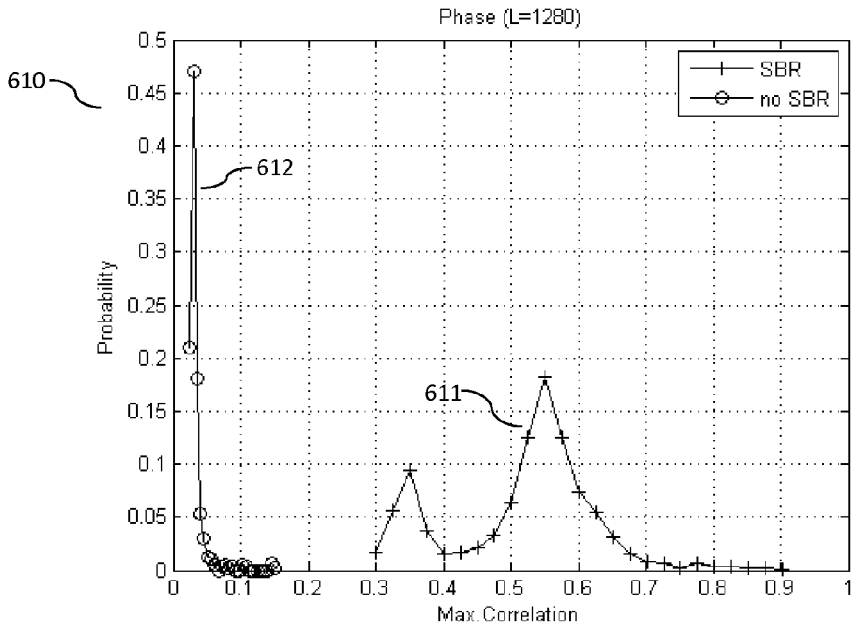
Figure 6C:
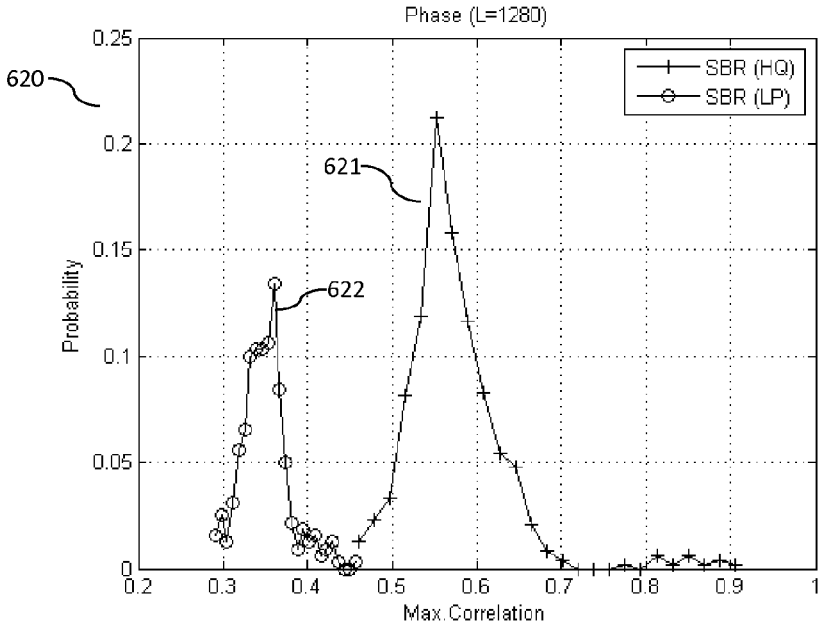

The probability density functions 600 and 610 conesponding to the maximum correlation values determined based on complex data and based on phase-only data are illustrated in FIGS. 6*a* and 6*b*, respectively. Furthermore, FIG. 6*c* shows an excerpt 620 of FIG. 6*b* in order to illustrate the possible detection of HQ SBR decoding (reference numeral 621) and LQ SBR decoding (reference numeral 622). It can be seen that when using complex data, the probability density function 602 for coding schemes without frequency extension overlaps partly with the probability density function 601 for coding schemes with frequency extension. On the other hand, when using phase-only data, the probability density functions 612 (coding schemes without frequency extension) and 611

(coding schemes with frequency extension) do not overlap, thereby enabling a robust detection scheme for SBR/SPX encoding. Furthermore, it can be seen from FIG. 6*c*, that the phase-only analysis method enables the distinction between particular coding modes. In particular, the phase-only analysis method enables the distinction between LP decoding (reference numeral 622) and HQ decoding (reference numeral 621).

As such, the use of highly selective analysis filter banks may improve the robustness of the similarity matrix based frequency extension detection schemes. Alternatively or in addition, line enhancement schemes may be applied in order to more clearly isolate the diagonal structures (i.e. the indicators for frequency patches) within the similarity matrix. An example line enhancement scheme may apply an enhancement matrix h to the similarity matrix C, e.g.

$$h = \frac{1}{6}\begin{bmatrix} 2 & -1 & -1 \\ -1 & 2 & -1 \\ -1 & -1 & 2 \end{bmatrix},$$

wherein a line enhanced similarity matrix may be determined by convolving the enhancement matrix h to the similarity matrix C. The maximum value of the line enhanced similarity matrix may be taken as an indicator of the presence of frequency extension within the audio signal.

The self-similarity matrices comprising the cross-correlation coefficients between subbands may be used to determine frequency extension parameters, i.e. parameters that were used for the frequency extension when encoding the audio signal. The extraction of particular frequency patching parameters may be based on line detection schemes in the self-similarity matrix. In particular, the lowbands which have been patched to highbands may be determined. This correspondence information may be useful for re-encoding, as the same or a similar correspondence between lowbands and highbands could be used.

Figure 7A:
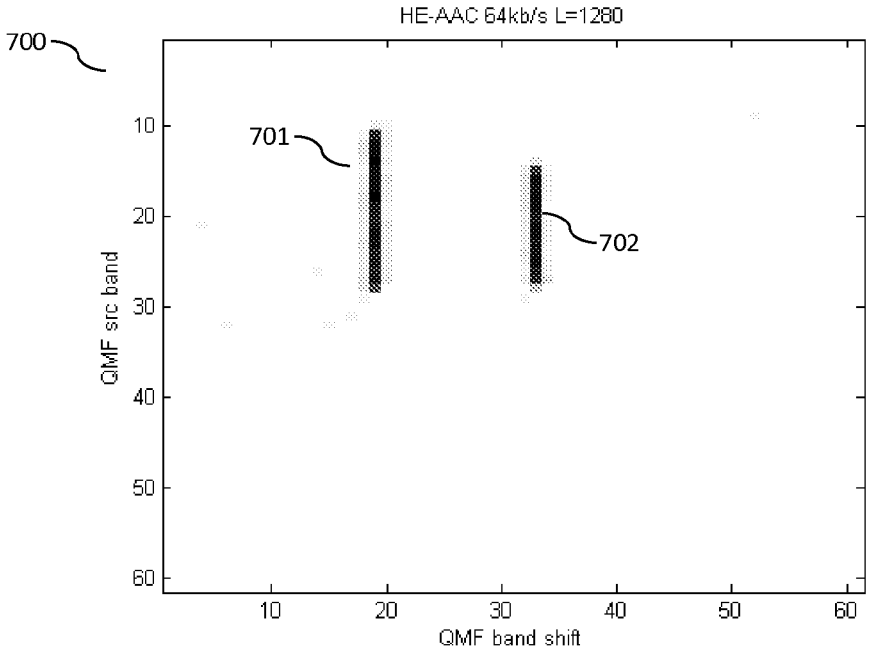
FIG. 7 illustrates example skewed similarity matrices used for patch detection.
Figure 7B:
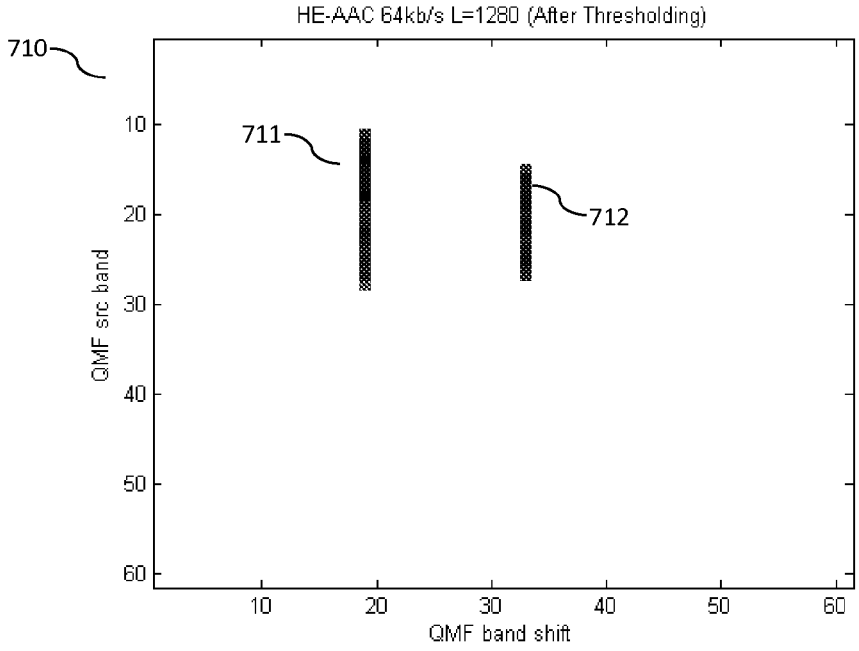

Considering the self-similarity matrix (e.g. matrix 410) as a grey level image, any line detection method (e.g., edge detection followed by Hough Transforms) known from image processing may be applied. For illustrative purposes, an example method has been implemented for evaluation as shown in FIG. 7.

In order to design an appropriate line detection scheme, codec specific information could be used in order to make the analysis method more robust. For instance, it may be assumed that lower frequency bands are used to patch higher frequency bands and not vice versa. Furthermore, it may be assumed that a patched QMF band may originate from only one source band (i.e. it may be assumed that patches do not overlap). On the other hand, the same QMF source band may be used in a plurality of patches. This may lead to increased correlation between patched highbands (as e.g. the diagonal 403 in FIG. 4*b*). Therefore, the method should be configured to distinguish between actual patches and inter-patch similarities. As a further assumption, it may be assumed that for standard dual-rate (non-oversampled) SBR, the QMF source bands are in the range of subband indexes 1-32.

Using some or all of the above assumptions, an example line detection scheme may apply any of the following steps:

- compute the phase-only based self-similarity matrix 410 in the QMF-domain (e.g. using a highly selective filter 302);
- tilt the similarity matrix 410 so that every line parallel to the main diagonal is represented by a vertical line; as a result, the x-axis corresponds to the frequency shift (as a number of subbands) which is applied to the source QMF bands (y axis) in order to determine the corresponding target QMF band;
- remove lines indicating patch-to-patch similarity; this may be achieved by applying knowledge with regards to the range of the source bands;
- remove lines outside the audio bandwidth; this may be achieved by determining the bandwidth of the audio signal, e.g. using power spectrum analysis;
- remove the main diagonal (i.e. the auto-correlations); after tilting of the similarity matrix 410, the main diagonal corresponds to the vertical line at x=0, i.e. at no frequency shift;
- detect one or more local maxima in the horizontal direction and set all the other correlation values within the tilted matrix to zero;
- set all the correlation values to zero which are below an (adaptive) threshold value;
- detect vertical lines (i.e. line with correlation values greater than the threshold and longer than one band).

FIG. 7 illustrates skewed similarity matrices prior to line processing (reference numeral 700) and after line processing (reference numeral 710), respectively. It can be seen that the blurred vertical patch lines 701 and 702 may be clearly isolated using the above scheme, thereby yielding patch lines 711 and 712, respectively.

Using the above approach (or similar line detection schemes) patch detection may be performed. In particular, the above approach has been evaluated for HE-AAC coding (coding conditions 1-8) listed in Table 1. The detection performance may be determined as a percentage of audio files for which all patch parameters have been identified correctly. It has been observed that phase-only data based analysis yields significantly better detection results for non-re-encoded HE-AAC (coding conditions 1-5) than complex data based analysis. For these coding conditions, the patching parameters (notably the mapping between source and target bands) can be determined with a high degree of reliability. As such, the estimated patching parameters may be used when re-encoding the audio signal, thereby avoiding or reducing further signal degradation due to the re-encoding process.

Figure 8:
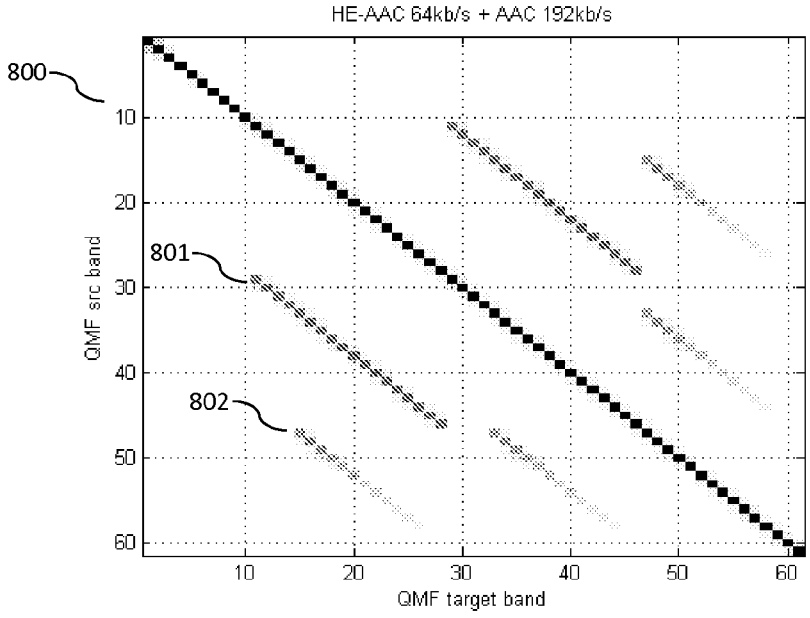
FIG. 8 shows an example similarity matrix for HE-AAC re-encoded data according to coding condition 6 of Table 1.

The patch parameter detection rate decreases for LP-SBR decoded signals compared to HQ-SBR decoded signals. For AAC re-encoded signals (coding conditions 6-8), the detection rates decrease significantly for both methods (phase-only data based and complex data based) to a low level. This has been analyzed in further detail. For condition 6 the similarity matrix 800 is shown in FIG. 8. It can be seen that the first patch 801 is rather prominent and can be identified correctly by the above described line detection scheme. On the other hand, the second patch 802 is less prominent. For the second patch 802 the source and target QMF bands have been detected correctly, but the number of QMF bands determined by the line detection scheme was too small. As can be seen in FIG. 8, this may be due to a decreasing correlation towards higher bands. Such fading lines may not be detected well by the threshold based algorithm outlined above. However, adaptive threshold line detection methods, e.g. the method described in Noboyuki Ostu, "A Threshold Selection Method from Gray-Level Histograms", IEEE Transactions on Systems, Man and Cybernetics, Vol. SMC-9, No. 1, January 1979, pages 62-66 (which used to convert a grey image to binary image), may be used to increase the robustness of the patch parameter determination scheme. The above document is incorporated by reference.

Figure 9:
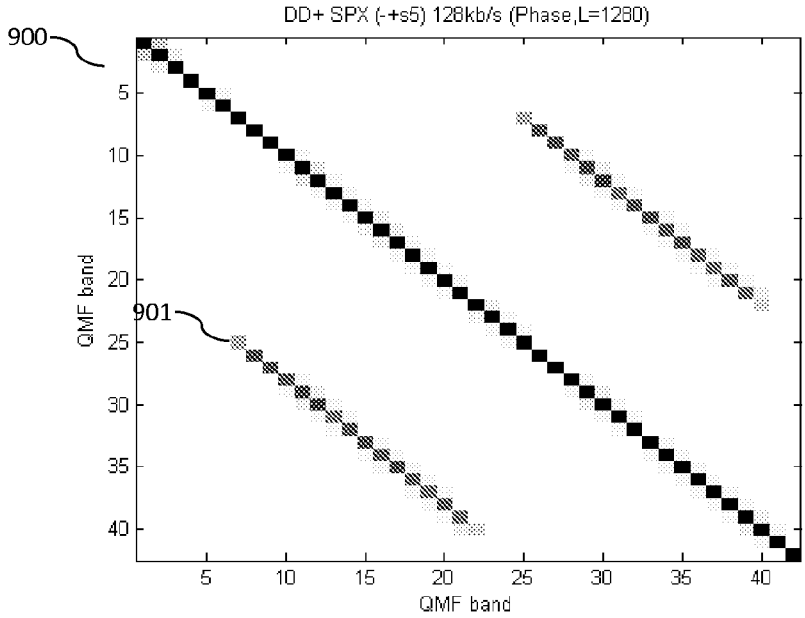
FIG. 9 illustrates an example similarity matrix for DD+ encoded data with SPX.

As has already been indicated above, the methods described in the present document may be applied to various frequency extension schemes including SPX encoding. As such, a similarity matrix may be determined based on an analysis filter bank resolution which does not necessarily correspond to the filter bank resolution used within the frequency band scheme which has been applied to the audio signal. This is illustrated in FIG. 9. An example similarity matrix 900 has been determined based on a 64 band complex QMF analysis of an audio signal which had been submitted to DD+ coding. The frequency patch 901 is clearly visible. However the patch start and end points are not easily detected. This may be due to the fact that the SPX scheme used in DD+ employs a filter bank having a finer resolution than the 64 band QMF used for determining the similarity matrix 900. More accurate results may be achieved using a filter bank with more channels, e.g. a 256 band QMF bank (which would be in accordance to the 256 coefficient MDCT used in DD/DD+). In other words, more accurate results may be achieved when using a number of channels which corresponds to the number of channels of the frequency extension coding scheme.

Overall it may be stated that the more accurate analysis results (both with respect to the actual detection of frequency extension coding, and with respect to the determination of patch parameters) may be achieved when using analysis filter banks with increased frequency resolution, e.g. a frequency resolution which is equal or higher than the frequency resolution of the filter bank used for frequency extension coding.

As pointed above, DD+ coding uses a different frequency resolution for frequency extension than HE-AAC. It has been indicated that when using a frequency resolution for the frequency extension detection which differs from the frequency resolution which had actually been used for the frequency extension, the patch borders, i.e. the lowest and/or highest bands of a patch may be blurred. This information may be used to determine information about the coding system which was applied on the audio signal. In other words, by evaluating the frequency patch borders, the coding scheme may be determined. By way of example, if the patch borders do not fall exactly on the 64 QMF band grid used for determining the similarity matrix, it may be concluded that the coding scheme is not HE-AAC.

Figure 10A:
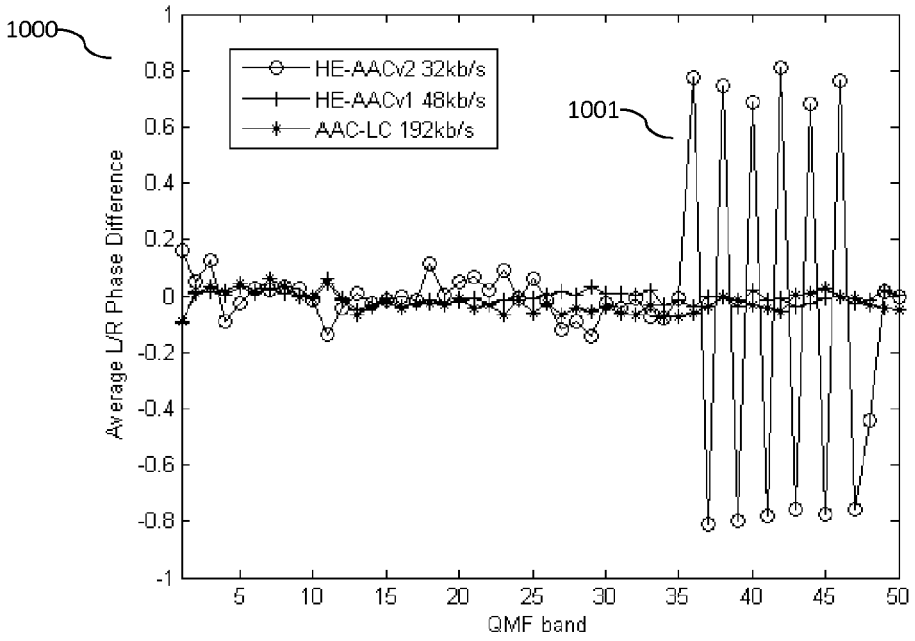
FIGS. 10*a* and 10*b* illustrate example phase difference graphs used for parametric stereo and coupling detection.

It may further be desirable to provide measures for detecting the use of Parametric Stereo (PS) encoding in HE-AACv2 and the use of Coupling in DD/DD+. PS is only relevant for stereo content, while Coupling is applied in stereo and multichannel audio. In the case of both tools, only data according to a single channel is transmitted within the bitstream along with a small amount of side information which is used in the decoder in order to generate the other channels (i.e. the second stereo channel or the multi-channels) from the transmitted channel. While PS is active over the whole audio bandwidth, Coupling is only applied at higher frequencies. Coupling is related to the concept of Intensity Stereo (IS) coding and can be detected from inter-channel correlation analysis or by comparing the phase information in the left and right channels. PS maintains the inter channel correlation characteristics of the original signal by means of a decorrelation scheme, therefore the phase relation between the left and right channels in PS is complex. However, PS decorrelation leaves a characteristic fingerprint in the average inter-channel phase difference as shown in FIG. 10*a*. This characteristic fingerprint can be detected.

An example method for detecting the use of PS encoding may apply any of the following steps:

perform a complex 64 band QMF analysis of both channels of the (decoded) audio signal;

compute left to right phase angle difference for every QMF bin; in other words, the phase of the complex samples within a QMF bin are evaluated; in particular, the difference of the phase of corresponding samples in the right and left channel is determined;

determine average phase angle differences over all QMF frames; example average phase angle differences 1000 for differently encoded signals are illustrated in FIG. 10*a;*

PS exhibits a characteristic periodic structure 1001 at high frequencies; this characteristic structure can be detected e.g. by peak filtering and energy computation.

Figure 10B:
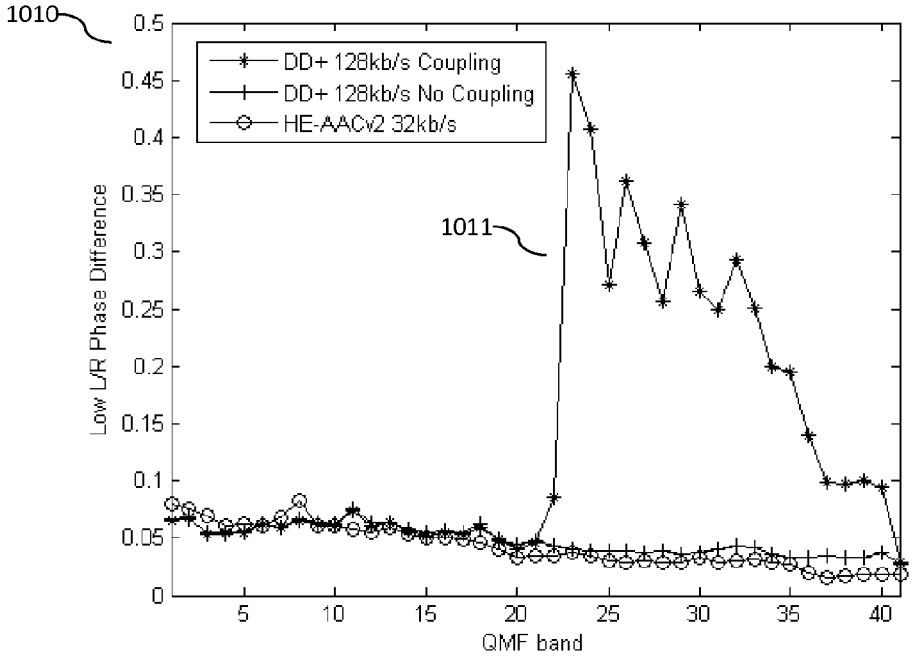

An example method for detecting the use of coupling (in the case of stereo content) may apply any of the following steps:

perform a complex 64 band QMF analysis of both channels of the (decoded) audio signal;

compute left to right phase angle differences for every QMF bin;

per QMF bin, compute the number of samples with low phase angle difference, i.e. with a phase angle difference which is below a predetermined threshold (typically phase angle difference<$\pi/100$) for every QMF band; example fractions/percentages 1010 of subband samples with low phase angle difference 1010 for differently encoded signals are illustrated in FIG. 10*b;* a significant increase along QMF bands as shown by graph 1011 in FIG. 10*b* may indicate the use of coupling.

As has been outlined above, a spectral bandwidth replication method generates high frequency coefficients based on information in the low frequency coefficients. This implies that the bandwidth replication method introduces a specific relationship or correlation between low and high frequency coefficients. In the following, a further approach for detecting that a (decoded) audio signal has been submitted to spectral bandwidth replication is described. In this approach, a probabilistic model is built that captures the specific relationship between low- and high-frequency coefficients.

In order to capture the relationship between low- and high-frequency coefficients, a training dataset comprising N spectral lowband vectors $\{x_1, x_2 \ldots x_N\}$ may be created. The lowband vectors $\{x_1, x_2 \ldots x_N\}$ are spectral vectors which may be computed from audio signals which have a predetermined maximum frequency $F_{narrow}$ (e.g. 8 kHz). That is, $\{x_1, x_2 \ldots x_N\}$ are spectral vectors computed from audio at a sampling rate of e.g. 16 kHz. The lowband vectors may be determined based on the low frequency bands of e.g. HE-AAC or MPEG SBR encoded audio signals, i.e. of audio signals which have a frequency extension coding history.

Furthermore, bandwidth extended versions of these N spectral vectors $\{x_1, x_2 \ldots x_N\}$ may be determined using a bandwidth replication method (e.g., MPEG SBR). The bandwidth extended versions of the vectors $\{x_1, x_2 \ldots x_N\}$ may be referred to as $\{y_1, y_2 \ldots y_N\}$. The maximum frequency content in $\{y_1, y_2 \ldots y_N\}$ may be a predetermined maximum frequency $F_{wide}$ (e.g. 16 kHz). This implies that the frequency coefficients between $F_{narrow}$ (e.g. 8 kHz) and $F_{wide}$ (e.g. 16-kHz) are generated based on $\{x_1, x_2 \ldots x_N\}$.

Given this training data set, a joint density of a set of the vectors $\{z_1, z_2 \ldots z_N\}$ where $z_j=\{x_j y_j\}$ (i.e. a concatenation of the narrow band spectral vector and wide band spectral vector) may be determined as:

$$p(z \mid \lambda) = \sum_{i=1}^{Q} \frac{\alpha_i}{(2\pi)^n |C_i|^{1/2}} \exp\left[-\frac{1}{2}(z-\mu_i)^T C_i^{-1}(z-\mu_i)\right], \quad (1)$$

$$\sum_{i=1}^{Q} \alpha_i = 1, \alpha_i \geq 0,$$

with n being the dimensionality of the vectors $z_i$. Q is the number of components in the Gaussian Mixture Model (GMM) used to approximate the joint density $p(z|\lambda)$, $\mu_i$ is the mean of the $i^{th}$ mixture component and $C_i$ is the covariance of the $i^{th}$ mixture component in the GMM.

Note that the covariance matrix of z (i.e. $C_i$) can be written as $$C_i = \begin{bmatrix} C_i^{xx} & C_i^{xy} \\ C_i^{yx} & C_i^{yy} \end{bmatrix},$$

where $C_i^{xx}$ refers to the covariance matrix of the lowband spectral vector, $C_i^{yy}$ refers to the covariance matrix of the wideband spectral vector, and $C_i^{xy}$ refers to the cross-covariance matrix between lowband and wideband spectral vector.

Similarly, the mean vector of z ($\mu_i$) can be written as $$\mu_i = \begin{bmatrix} \mu_i^x \\ \mu_i^y \end{bmatrix},$$

where $\mu_i^x$ is the mean of the lowband spectral vector of the $i^{th}$ mixture component and $\mu_i^y$ is the mean of the wideband spectral vector of the $i^{th}$ mixture component.

Based on the joint density, i.e. based on the determined mean vectors $\mu_i$ and covariance matrices $C_i$ a function F(x) may be defined that maps the lowband spectral vectors ($x_i$) to wideband spectral vectors ($y_i$). In the present example, F(x) is chosen such that it minimizes the mean squared error between the original wideband spectral vector and the reconstructed spectral vector. Under this assumption, F(x) may be determined as $$F(x) = E[y \mid x] = \sum_{i=1}^{Q} h_i(x)[\mu_i^y + C_i^{yx} C_i^{xx-1}(x-\mu_i^x)]. \quad (2)$$

Here E[y|x] refers to the conditional expectation of y given the observed lowband spectral vector x. The term $h_i(x)$ refers to the probability that the observed lowband spectral vector x is generated from the $i^{th}$ mixture component of the estimated GMM (see equation (1)).

The term $h_i(x)$ can be computed as follows $$h_i(x) = \frac{\frac{\alpha_i}{(2\pi)^{n/2}|C_i^{xx}|^{1/2}} \exp\left[-\frac{1}{2}(x-\mu_i^x)^T C_i^{xx-1}(x-\mu_i^x)\right]}{\sum_{j=1}^{Q} \frac{\alpha_j}{(2\pi)^{n/2}|C_j^{xx}|^{1/2}} \exp\left[-\frac{1}{2}(x-\mu_j^x)^T C_j^{xx-1}(x-\mu_j^x)\right]}.$$

Using the above described statistical model, an SBR detection scheme may be described as follows. Based on equations (1) and (2) the relationship between low and high frequency components may be captured using a training data set comprising lowband spectral vectors and their corresponding wideband spectral vectors.

Given a novel wideband spectral vector (u) which is determined from a novel (decoded) audio signal, the statistical model may be used to determine whether the high frequency spectral components of the (decoded) audio signal were generated based on a bandwidth replication method. The following steps may be performed in order to detect whether bandwidth replication was performed:

The input wideband spectral vector (u) may be split into two parts $u=[u_x\ u_{hi}]$, wherein $u_x$ corresponds to the lowband spectral vector, and $u_{hi}$ corresponds to the high frequency part of the spectrum of the audio signal which may or may not have been created by a bandwidth replication method.

By using the probabilistic model and in particular by using equation (2) a wideband vector $F(u_x)$ may be estimated based on $u_x$. The prediction error $\|u-F(u_x)\|$ would be small if the high frequency components were generated according to the probabilistic model in equation (1). Otherwise, the prediction error would be large indicating that the high frequency components were not generated by a bandwidth replication method. Consequently, by comparing the prediction error $\|u-F(u_x)\|$ with a suitable error threshold, it may be detected whether SBR was performed on the input vector "u", i.e. whether the (decoded) audio signal had been submitted to SBR processing.

It should be noted that the above statistical model may alternatively be determined using the lowband vectors $\{x_1, x_2 \ldots x_N\}$ and the corresponding highband vectors $\{y_1, y_2 \ldots y_N\}$, wherein the highband vectors $\{y_1, y_2 \ldots y_N\}$ have been determined from $\{x_1, x_2 \ldots x_N\}$ using a bandwidth replication method (e.g., MPEG SBR). This means that the vectors $\{y_1, y_2 \ldots y_N\}$ only comprise the highband components which were generated using the bandwidth replication method and not the lowband components from which the highband components are generated. The set of the vectors $\{z_1, z_2 \ldots z_N\}$, where $z_j=\{x_j\ y_j\}$, is determined as a concatenation of the low band spectral vector and the high band spectral vector. By doing this, the dimension of the Gaussian Mixture Model (GMM) can be reduced, thereby reducing the overall complexity. It should be noted that the equations described above are also applicable to the case with $\{y_1, y_2 \ldots y_N\}$ being the highband vectors.

In the present document, methods and systems for analyzing a (decoded) audio signal have been described. The methods and systems may be used to determine if the audio signal had been submitted to a frequency extension based codec, such as HE-AAC or DD+. Furthermore, the methods and systems may be used to detect specific parameters which were used by the frequency extension based codec, such as corresponding pairs of low frequency subbands and high frequency subbands, decoding modes (LP or HQ decoding), the use of parametric stereo encoding, the use of coupling, etc. The described method and systems are adapted to determine the above mentioned information from the (decoded) audio signal alone, i.e. without any further information regarding the history of the (decoded) audio signal (e.g. a PCM audio signal).

The method and system described in the present document may be implemented as software, firmware and/or hardware. Certain components may e.g. be implemented as software running on a digital signal processor or microprocessor. Other components may e.g. be implemented as hardware and or as application specific integrated circuits.

The invention claimed is:

1. A method for detecting frequency extension coding in the coding history of an audio signal, the method comprising providing a plurality of subband signals in a corresponding plurality of subbands comprising low and high frequency subbands, the plurality of subband signals generated using a filter bank comprising a plurality of filters; wherein the plurality of subband signals corresponds to a time/frequency domain representation of the audio signal;

determining a degree of relationship between subband signals in the low frequency subbands and subband signals in the high frequency subbands; wherein the degree of relationship is determined based on the plurality of subband signals;

wherein determining the degree of relationship comprises determining a set of cross-correlation, wherein the set of cross-correlation values comprises a subset of elements of a K x K similarity matrix, wherein the K x K similarity matrix comprises cross-correlation values corresponding to all pairs of subband signals from the plurality of subband signals;

wherein determining a cross-correlation value comprises determining an average over time of products of corresponding samples of a first and a second subband signal at zero time lag; and determining frequency extension coding history if the degree of relationship is greater than a relationship threshold.

2. The method of claim 1, wherein the plurality of subband signals are generated using one of a complex valued pseudo quadrature mirror filter bank;

a modified discrete cosine transform;

a modified discrete sine transform;

a discrete Fourier transform;

modulated lapped transform;

complex modulated lapped transform; or a fast Fourier transform.

3. The method of claim 1, wherein each of the plurality of filters has a roll-off which exceeds a predetermined roll-off threshold for frequencies lying within a stopband of the respective filter.

4. The method of claim 1, wherein the audio signal comprises a plurality of audio channels;

the method comprises downmixing the plurality of audio channels to determine a downmixed time domain audio signal; and the plurality of subband signals is generated from the downmixed time domain audio signal.

5. The method of claim 1, further comprising determining a maximum frequency of the audio signal; wherein the plurality of subband signals only comprise frequencies at or below the maximum frequency.

6. The method of claim 5, wherein determining a maximum frequency comprises analyzing a power spectrum of the audio signal in the frequency domain; and determining the maximum frequency such that for all frequencies greater than the maximum frequency, the power spectrum is below a power threshold.

7. The method of claim 1, wherein the plurality of subband signals is a plurality of complex subband signals comprising a plurality of phase signals and a corresponding plurality of magnitude signals, respectively; and the degree of relationship is determined based on the plurality of phase signals and not based on the plurality of magnitude signals.

8. The method of claim 1, wherein determining a degree of relationship comprises determining a group of subband signals in the high frequency subbands which has been generated from a group of subband signals in the low frequency subbands.

9. The method of claim 1, wherein the plurality of subband signals comprises K subband signals; and the set of cross-correlation values comprises (K−1)! Cross-correlation values corresponding to all combinations of different subband signals from the plurality of subband signals.

10. The method of claim 1, wherein determining frequency extension coding history comprises determining that at least one maximum cross-correlation value from the set of cross-correlation values exceeds the relationship threshold.

11. The method of claim 1, further comprising determining that a maximum cross-correlation value from the set of cross-correlation values is either below or above a decoding mode threshold, thereby detecting a decoding mode of a frequency extension coding scheme applied to the audio signal.

12. The method of claim 1, wherein the audio signal is a multi-channel signal comprising a first and a second channel, and wherein the method further comprises transforming the first and the second channel into the frequency domain, thereby generating a plurality of first subband signals and a plurality of second subband signals; wherein the first and second subband signals are complex-valued and comprise first and second phase signals, respectively; and determining a plurality of phase difference subband signals as the difference of corresponding first and second subband signals.

13. The method of claim 12, further comprising determining a plurality of phase difference values, wherein each phase difference value is determined as an average over time of samples of the corresponding phase difference subband signal; and detecting a periodic structure within the plurality of phase difference values, thereby detecting parametric stereo encoding in the coding history of the audio signal.

14. The method of claim 13, wherein the periodic structure comprises an oscillation of phase difference values of adjacent subbands between positive and negative phase difference values; wherein a magnitude of the oscillating phase difference values exceeds an oscillation threshold.

15. The method of claim 12, further comprising for each phase difference subband signal, determining a fraction of samples having a phase difference smaller than a phase difference threshold;

detecting that the fraction exceeds a fraction threshold for subband signals in the high frequency subbands, thereby detecting a coupling of the first and second channel in the coding history of the audio signal.

16. A non-transitory medium that is readable by a device and that records a program of instructions executable by the device to perform a method for detecting frequency extension coding in the coding history of an audio signal, wherein the method comprises:

providing a plurality of subband signals in a corresponding plurality of subbands comprising low and high frequency subbands, the plurality of subband signals generated using a filterbank comprising a plurality of filters; wherein the plurality of subband signals corresponds to a time/frequency domain representation of the audio signal;

determining a degree of relationship between subband signals in the low frequency subbands and subband signals in the high frequency subbands; wherein the degree of relationship is determined based on the plurality of subband signals;

wherein determining the degree of relationship comprises determining a set of cross-correlation values, wherein the set of cross-correlation values comprises a subset of elements of a K x K similarity matrix, wherein the K x K similarity matrix comprises cross-correlation values corresponding to all pairs of subband signals from the plurality of subband signals;

wherein determining a cross-correlation value comprises determining an average over time of products of corresponding samples of a first and a second subband signal at zero time lag; and determining frequency extension coding history if the degree of relationship is greater than a relationship threshold.

17. An apparatus for detecting frequency extension coding in the coding history of an audio signal, the apparatus comprising one or more processors configured to:

provide a plurality of subband signals in a corresponding plurality of subbands comprising low and high frequency subbands, the plurality of subband signals generated using a filterbank comprising a plurality of filters; wherein the plurality of subband signals corresponds to a time/frequency domain representation of the audio signal;

determine a degree of relationship between subband signals in the low frequency subbands and subband signals in the high frequency subbands; wherein the degree of relationship is determined based on the plurality of subband signals;

wherein determining the degree of relationship comprises determining a set of cross-correlation values, wherein the set of cross-correlation values comprises a subset of elements of a K x K similarity matrix, wherein the K x K similarity matrix comprises cross-correlation values corresponding to all pairs of subband signals from the plurality of subband signals;

wherein determining a cross-correlation value comprises determining an average over time of products of corresponding samples of a first and a second subband signal at zero time lag; and determine frequency extension coding history if the degree of relationship is greater than a relationship threshold.

* * * * *